United States Patent [19]

Apps et al.

[11] Patent Number: 4,978,002

[45] Date of Patent: Dec. 18, 1990

[54] CROSS-STACKING BOTTLE CASE

[75] Inventors: William P. Apps, Anaheim; James B. Rehrig, Rancho Palos Verde, both of Calif.; John A. Hagan, Aldan, Pa.

[73] Assignee: Rehrig-Pacific Company, Inc., Los Angeles, Calif.

[21] Appl. No.: 440,255

[22] Filed: Nov. 22, 1989

Related U.S. Application Data

[62] Division of Ser. No. 186,140, Apr. 26, 1988, Pat. No. 4,899,874.

[51] Int. Cl.[5] ..... B65D 27/00

[52] U.S. Cl. ..... 206/201; 206/203; 206/109; 206/171

[58] Field of Search ..... 206/201, 203, 427, 509, 206/511; 200/20, 22, 21

[56] References Cited

U.S. PATENT DOCUMENTS

| | | | |
|---|---|---|---|
| D. 147,981 | 11/1947 | Lehman | D58/13 |
| D. 195,702 | 7/1963 | Russo | D58/26 |
| D. 201,257 | 6/1965 | Vidal | D58/5 |
| D. 289,938 | 5/1987 | Warwick | 205/203 |
| 1,112,943 | 10/1914 | Stone . | |
| 2,064,518 | 12/1936 | Brogden | 220/97 |
| 2,411,673 | 11/1946 | Vechey, Jr. | 220/21 |
| 2,530,481 | 11/1950 | Rawn, Jr. | 220/76 |
| 2,535,493 | 12/1950 | Gerber | 220/97 |
| 2,588,805 | 2/1951 | Cross | 220/21 |
| 2,626,079 | 1/1953 | Keller | 220/21 |
| 2,743,030 | 4/1956 | Read, Jr. | 220/21 |
| 2,760,676 | 8/1956 | Kniereim | 220/97 |
| 2,840,256 | 6/1958 | Cobb, Jr. | 220/4 |
| 2,928,530 | 3/1960 | Sauey | 206/3 |
| 2,935,222 | 5/1960 | O'Connell | 220/21 |

(List continued on next page.)

FOREIGN PATENT DOCUMENTS

| | | |
|---|---|---|
| 247904 | 8/1962 | Australia . |
| 680197 | 10/1966 | Belgium . |
| 693216 | of 1967 | Belgium . |
| 965056 | 3/1975 | Canada . |
| 1109433 | 9/1981 | Canada . |
| 99827 | 2/1984 | European Pat. Off. . |
| 1207268 | 6/1966 | Fed. Rep. of Germany . |
| 1486412 | 5/1969 | Fed. Rep. of Germany . |
| 1285689 | 4/1961 | France . |
| 1351218 | 3/1963 | France . |
| 1518610 | 2/1968 | France . |
| 2401087 | of 1979 | France . |
| 6505562 | 10/1966 | Netherlands . |
| WO82/01536 | 5/1982 | PCT Int'l Appl. . |
| 2135278 | 8/1924 | United Kingdom . |
| 943947 | 12/1963 | United Kingdom . |
| 1032916 | 6/1966 | United Kingdom . |
| 1115343 | 5/1968 | United Kingdom . |
| 1120067 | 7/1968 | United Kingdom . |
| 1152038 | 5/1969 | United Kingdom . |
| 1312701 | 4/1970 | United Kingdom . |
| 1319726 | 6/1973 | United Kingdom . |
| 1330778 | 9/1973 | United Kingdom . |
| 2079256 | 1/1982 | United Kingdom . |
| 2158044A | 11/1985 | United Kingdom . |

*Primary Examiner*—Joseph Man-Fu Moy
*Attorney, Agent, or Firm*—Banner, Birch, McKie & Beckett

[57] ABSTRACT

The stackable low depth bottle case of the present invention includes four side walls and a bottom portion. A plurality of upwardly projecting hollow columns extend upwardly within the side walls. The columns, walls, and bottom portion define a plurality of bottle retaining pockets. The bottle retaining pockets have flat surfaces to permit retention of bottles without base indentations and to permit rotation of petaloid bottles. The columns extend upwardly from the base portion a distance approximately one third of the height of the bottles to be retained. The columns may be hollow to permit empty cases to stack top to bottom. The lower surface of the bottom portion has circular concave portions with central retaining openings to facilitate stacking of loaded cases top to bottom. When a case is disposed on a lower filled case, the bottle tops of the lower case are guided toward the central retaining openings by the circular concave portions.

72 Claims, 12 Drawing Sheets

U.S. PATENT DOCUMENTS

| | | | |
|---|---|---|---|
| 2,970,715 | 2/1961 | Kappel et al. | 220/21 |
| 2,974,819 | 3/1961 | Melville | 220/20 |
| 3,055,542 | 9/1962 | Russo | 220/104 |
| 3,151,762 | 10/1964 | Vidal | 220/21 |
| 3,247,996 | 4/1966 | Garcia | 220/21 |
| 3,283,947 | 11/1966 | Cornelius | 220/120 |
| 3,326,410 | 6/1967 | Asenbauer | 220/97 |
| 3,333,729 | 8/1967 | Rabb | 220/116 |
| 3,349,943 | 10/1967 | Box | 220/21 |
| 3,376,998 | 4/1968 | Cornelius | 220/120 |
| 3,379,339 | 4/1968 | Asenbauer | 220/97 |
| 3,384,261 | 5/1968 | Austin | 220/21 |
| 3,390,801 | 7/1968 | Adomat | 220/21 |
| 3,392,869 | 7/1968 | Needt | 220/5 |
| 3,416,694 | 12/1968 | Bebb | 220/21 |
| 3,547,309 | 12/1970 | Pesey . | |
| 3,701,449 | 10/1972 | Schoeller | 220/21 |
| 3,759,416 | 9/1973 | Constantine | 220/97 F |
| 3,812,996 | 5/1974 | Bunnell | 220/21 |
| 3,865,239 | 2/1975 | Herolzer et al. | 206/507 |
| 4,027,796 | 6/1977 | Martin | 206/507 |
| 4,037,722 | 7/1977 | Bremer | 206/523 |
| 4,040,517 | 8/1977 | Torokvei | 206/144 |
| 4,071,162 | 1/1978 | Steinlein et al. | 220/21 |
| 4,095,720 | 6/1978 | Delbrouck et al. | 220/21 |
| 4,101,049 | 7/1978 | Wallace et al. | 229/2.5 |
| 4,105,117 | 8/1978 | Atkin et al. | 206/501 |
| 4,120,444 | 10/1978 | Gray | 229/49 |
| 4,162,738 | 7/1979 | Wright | 220/21 |
| 4,204,596 | 5/1980 | Davis | 206/203 |
| 4,319,685 | 3/1982 | David | 206/507 |
| B1,4,344,530 | 3/1983 | deLarosiere | 206/203 |
| 4,410,099 | 10/1983 | deLarosiere | 220/21 |
| 4,416,373 | 11/1983 | deLarosiere | 206/432 |
| 4,700,836 | 10/1987 | Hammett | 206/427 |
| 4,700,837 | 10/1987 | Hammett | 206/427 |
| 4,773,554 | 9/1988 | Warwick | 220/21 |
| 4,789,063 | 12/1988 | Hammett | 206/432 |
| 4,823,955 | 4/1989 | Apps | 206/506 |
| 4,899,874 | 2/1990 | Apps et al. | 206/201 |

CROSS-STACKING BOTTLE CASE

This application is a division of Ser. No. 186,140, filed Apr. 26, 1988, now U.S. Pat. No. 4,899,874.

TECHNICAL FIELD

The present invention relates to low depth stackable bottle cases for use in retaining and transporting bottles. More particularly, the present invention relates to beverage bottle cases that combine low depth with high stability for stored bottles.

BACKGROUND OF THE INVENTION

Plastic bottles are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and thus can safely contain the pressure of a cabonated beverage. Moreover, conventional PET bottles can bear suprisingly high compressive loads, provided that the load is directed substantially along an axially symmetric axis of the bottle. A single PET bottle can support the weight of many bottles of the same size filled with beverage if the bottle is standing upright on a flat, horizontal surface and the weight of the other bottles is applied to the closure of the single bottle and is directed substantially vertically along the symmetric axis. However, if a compressive load is applied to a conventional PET beverage bottle along a direction other than the symmetry axis of the bottle, the bottle tends to buckle. This tendency of conventional PET bottles to give way under off-axis compressive load is particularly pronounced for large capacity bottles, such as the two-liter bottle widely used for marketing soft drinks.

Soft drink bottles are ordinarily packaged by bottlers in cases or other containers, several bottles to the case, for shipment to retailers or for storage. Cases of bottles are customarily stacked on top of each other. In warehouse, cases of bottles are frequently stacked on pallets which can be lifted and moved about by fork-lift trucks. The stacks of cases on the pallets must therefore be particularly stable in order to remain standing in the face of the jostling inherent in being moved about. A technique for interconnecting columns of cases, called "cross stacking," is often used to improve the stability of cases of bottles loaded on a warehouse pallet. Cross stacking generally involves stacking rectangular bottle cases to build up a layered structure, with each layer having cases oriented parallel to each other and with the cases in adjacent layers being oriented at right angles to each other. Since each case in the cross-stacked layer rests on at least two cases in the layer below, the cases of the cross-stacked layer tend to keep the cases on which they rest from moving apart from each other. The cross-stacked layer therefore stabilizes the structure.

Because of the tendency of conventional PET beverage bottles to buckle under off-axis loads, attempts to stack cases of these bottles give rise to serious problems. Bottles can tilt away from vertical alignment upon stacking if conventional partitioned cases having low side walls are used to contain the bottles. Tilted bottles in the lower cases of a stack can buckle and give way, causing the stack to fall. Even absent buckling, the tendency of bottles to tilt in conventional low-sided cases causes problems. Tilting generally places an undesirably low limit on the number of tiers in a stack since the tilting of bottles in one case can cause the next higher case in the stack to tilt. This leads to instability if too many tiers are included in the stack.

Previously, these problems were dealt with by packaging beverage bottles in corrugated-paper cartons having high sides, often equal in height to the height of the bottles. Two-liter PET bottles filled with soft drinks were oftem packaged in enclosed corrugated paper cartons for storage and shipment. Although the high side of these paper cartons reduce the incidence of tilting and provide additional support when the cartons are stacked, the cartons are expensive. The cost of the cartons cannot ordinarily be distributed over a number of repeated uses since corrugated-paper cartons generally are not rugged enough for reuse and therefore they are usually discarded by the retailer.

One solution to the problems of full depth corrugated-paper cartons is plastic full depth cases. In plastic full depth cases, the sides are load bearing. Full depth plastic cases also have numerous disadvanatges. They are expensive to manufacture. They are also expensive to ship and to store empty in a user's warehouse as they require lots of space. Also, they totally surround the bottles, thereby preventing display of the bottles.

To overcome these problems plastic low depth cases have been used. A low depth case in one in which the side walls are lower than the height of the stored bottles, and in which the bottles support the weight of additional cases stacked on top. Some examples of low depth cases follow. However, these two have drawbacks. Some cases, such as the cases disclosed in the deLarosiere, require additional structure to hold the bottles and insure complete bottle stability, even though the case depth is more than 25% of the height of the bottles.

Various plastic reusable bottle carriers are known in the art. One reusable bottle carrier is disclosed in U.S. Pat. No. 3,055,542 to Russo. The bottle carrier can be made of a plastic, and is assembled from two pieces: a handle and a carrier body having six cups for soft-drink bottles. In order to stack the bottle carriers when empty, the handles must be removed. This is very inconvenient and time consuming. The '542 bottle carrier is also seriously limited regarding stacking loaded carriers. It cannot be stacked in a conventional cross-stacked structure because, as shown in FIGS. 3 and 10, the spacing between the bottles in the carriers is different in the directions parallel and perpendicular to the handle of the carrier.

Kappel U.S. Pat. No. 2,970,715 is one of the earlier embodiments of molded plastic low depth bottle carrying cases. Each bottle rests on a raised flat surface within an individual compartment. The bottom of the case is formed with recesses for receiving bottle tops when loaded cases are vertically stacked. However, Kappel does not indicate the size of the carrying case relative the bottles being carried.

In Bunnel, U.S. Pat. No. 3,812,996, a reusable plastic bottle carrying case for beer bottles is disclosed. The case is designed with a plurality of bottle compartments having flat bottom walls. The cases are designed to be cross-stacked; the cases are dimensioned so that the center-to-center distance between adjacent bottles within a case is the same as the center-to-center distance between adjacent bottles in adjacent cases in abutting relationship. The bottles are co-linear. Although a plurality of loaded carrying cases is designed to be vertically stackable with the weight of upper cases supported by the bottles within lower cases, the outer surface of the bottom wall of the case is flat.

Garcia, U.S. Pat. No. 3,247,996 discloses a low depth plastic bottle container for milk bottles. The container is shorter than the bottles which extend above the top surface of the container walls. In Garcia, the bottles, rather than the walls of the container, are load bearing. Indented circular portions may be formed in the bottom wall to receive bottle tops when containers are vertically stacked. Like many prior art bottle carriers, the Garcia container is a low depth case that can be used with a variety of bottles. However, the case is not a very low depth case and is more expensive than very low depth cases. It also does not have the display capabilities of very low depth cases.

A more recent attempt to solve the problem of providing reusable, cross-stackable PET bottle cases is disclosed in U.S. Pat. No. 4,344,530 to deLarosiere. The U.S. Pat. No. '530 has many of the features and problems of Garcia and discloses a plastic PEt bottle case that is cross stackable and has a very low depth as shown in the figures. This low depth is disclosed as being approximately 1/6 the height of the PET bottles, or approximately 2 inches. However, in practice, this depth is insufficient and does not prevent bottles from tipping over. This creates a large degree of lateral instability. In practice these cases are 3–3¼ inches high. Additionally, the bottle retaining pockets are required to have a raised annular bottle seat ring which fits within the inner indentation formed in the base of many bottles to insure bottle stability. Also, this does not permit pentaloid bottles to rotate within the bottle pockets for display purposes. Additionally, it does not permit bottles without a base indentation to be adequately retained. deLarosiere also incorporates a bottle spacing feature that co-linearly aligns bottles to facilitate cross-stacking.

SUMMARY OF THE INVENTION

It is an object of the present invention to provide a durable plastic reusable bottle case having a very low depth that is stable when full cases or empty cases are stacked on top of each other.

It is another object of the present invention to provide a stackable bottle case in which bottles do not tip when a plurality of loaded cases are stacked on top of each other, in which additional bottle base support structure is unnecessary, in which bottles without base identations may be retained, and in which petaloid bottles may be rotated.

It is another object of the present invention to provide a bottle case having the above features that uses less material, is lighter in weight, and is cheaper to manufacture.

These and other objects are attained by the stackable low depth case of the present invention. The case includes four side walls and a bottom portion. A plurality of upwardly projecting hollow columns are disposed in the bottom portion. These columns preferably do not extend from the top surface of the bottom portion. The columns, walls, and bottom portion define a plurality of bottle retaining pockets. The bottle retaining pockets have flat bottom surfaces to permit retention of bottles without base identations and to permit rotation of bottles. The columns extend upwardly from the base portion a distance approximately one third of the height of the bottles to be retained. The columns are hollow to permit empty cases of stack top to bottom. The lower surface of the bottom portion has circular concave portions with central retaining openings to facilitate stacking of filled cases top to bottom. When a case is disposed on a loaded lower case, the bottle tops of the bottles in the lower case are guided toward the central retaining openings by the circular concave portions.

The casee of this invention has a very low depth with upwardly extending columns. This provides numerous advantages. This case may be formed without special bottle case supports because the columns give the case a higher effective height. This also enhances bottle visibility and reduces manufacturing costs.

The case may be used for any size bottles such as 2-liter and 3-liter bottles. The case may be shaped to receive 6, 8, or any other number of bottles as well as 6-packs and 8-packs. Additionally the effectuve height of the case, the total column height, need not be limited to ⅓ the height of the bottles.

Various additional advantages and features of novelty which characterized the invention are further pointed out in the claims that follow. However, for a better understanding of the invention and its advantages, reference should be made to the accompanying drawings and descriptive matter which illustrated and described preferred embodiments of the invention.

DETAILED DESCRIPTION OF PREFERRED EMBODIMENTS

Figure 1:
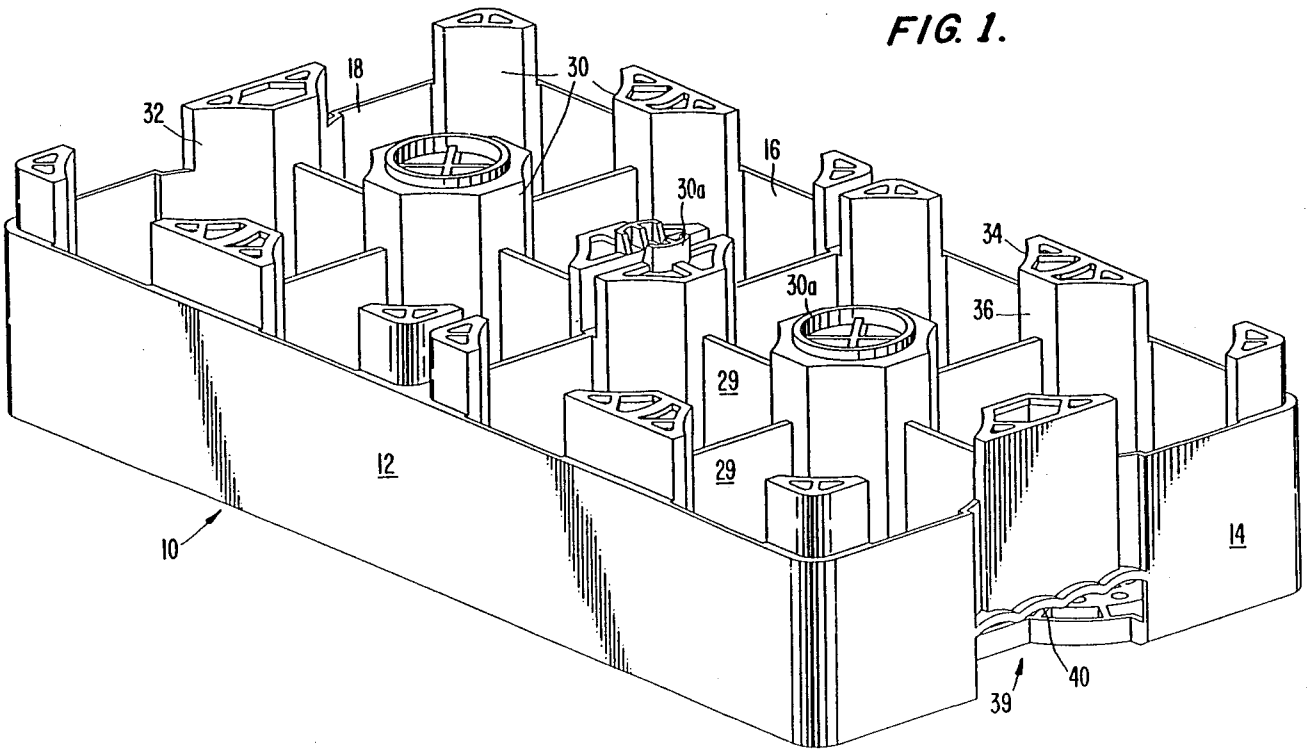
FIG. 1 is a perspective view of a stackable low depth case according to the present invention.

As shown in FIG. 1, the stackable low depth bottle case 10 has four side walls 12, 14, 16, 18. The top surfaces of these four side walls are identified as 12', 14', 16' and 18'. Side walls 12, 16 are relatively long and side walls 14, 18 (end walls) are relatively short. Case 10 is rectangular and is therefore symmetric about both center lines 17 and 19 which bisect the bottom surface. Center line 17 of the length of the case extends through the center of the longer pair of side walls 12 and 16 of the case. Center lines 19 of the case extends through the center of the shorter pair of side (i.e., and) walls 14 and 18 of the case. The depth or height of side walls 12, 14 16 ,18 is relatively low compared to the height of the bottles retained therein. Preferably, case 10 is rectangular and symmetric around both central axes. The ratio of the length of long side walls 12, 16 to the length of short side walls 14, 18 is substantially equal to the ratio of the number of bottles the case holds in the lengthwise direction to the number of bottles the case holds in the widthwise direction. For example, an 8-bottle case is twice as long as it is wide and holds bottles in a 4×2 relationship.

Figure 4:
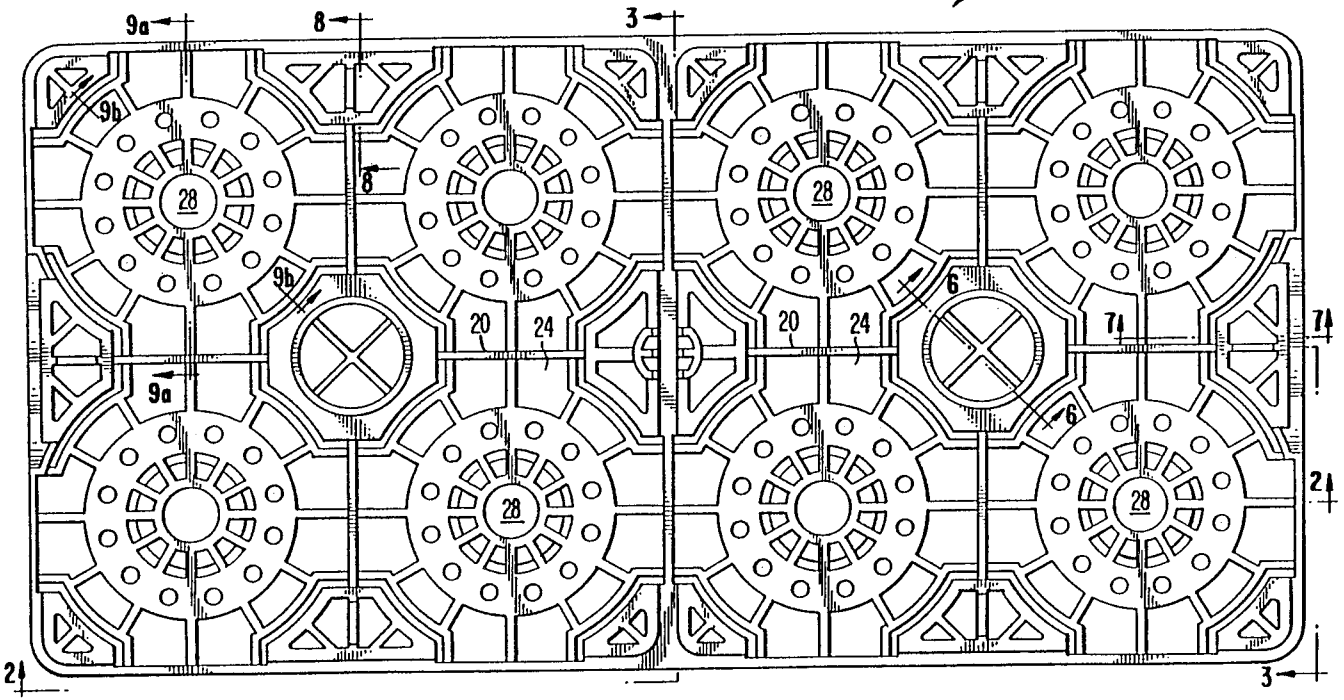
FIG 4 is a top view of the case of FIG 1.
Figure 5:
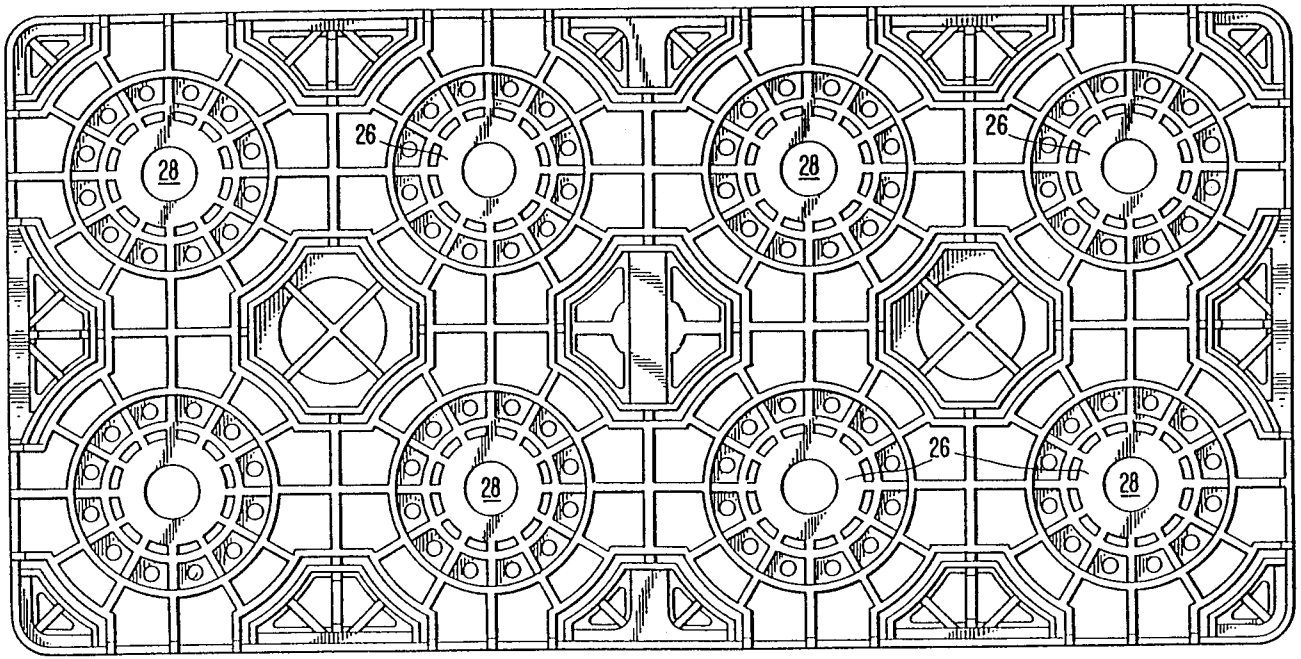
fIG. 5 is a bottom view of the case of FIG. 1.
Figure 6:
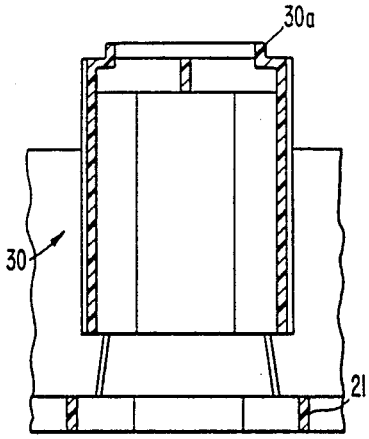
FIG. 6 is a sectional view taken along line 6—6 of FIG. 4.
Figure 7:
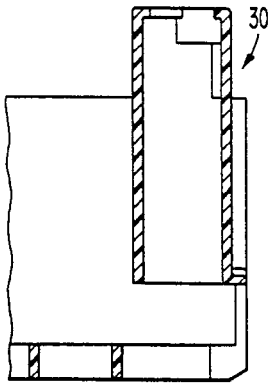
FIG. 7 is a sectional view taken along line 7—7 of FIG. 4.
Figure 8:
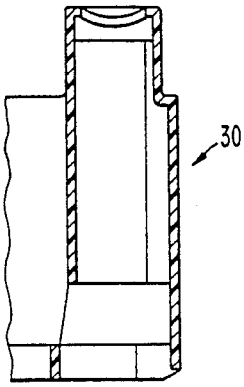
FIG. 8 is a sectional view taken along line 8—8 of FIG. 4.
Figure 9B:
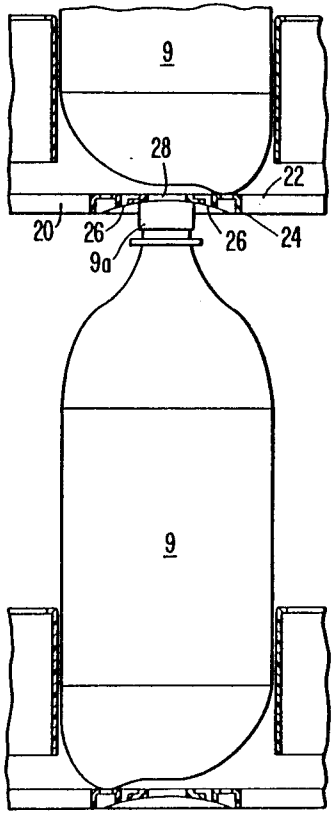
FIG. 9*b* is taken along line 9*b*—9*b* of FIG. 4**.
Figure 9A:
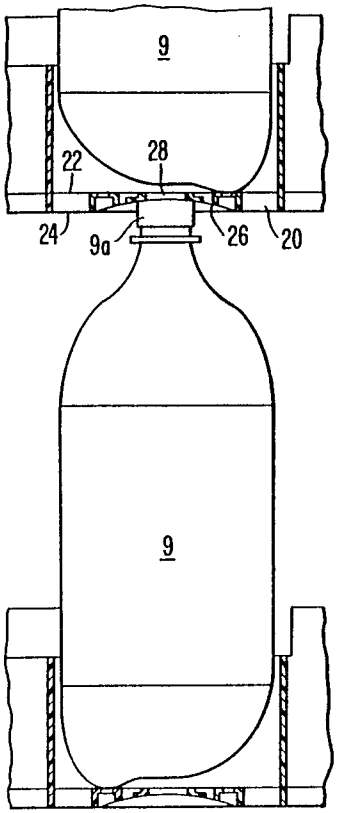
FIG. 9 shows partial sectional views illustrating an upper case stacked on top of a lower case with the lower case filled with bottles. FIG. **9*a* is taken along line 9*a*—9*a* of FIG. 4.

As best shown in FIGS. 4 and 5, case 10 also includes a bottom portion 20 attached to side walls 12, 14, 16, 18 to form the outer sheel of case 20. Preferably, case 10 is made from plastic and is molded integrally as a single component. Bottom portion 20 has an upper surface 22 and a lower surface 24. Upper surface 22 is substantially flat. Lower surface 24 is formed as a plurality of circular concave portions 26 each having a central retaining opening 28 disposed therein. The number of circular concave portions corresponds to the number of bottles the case is designed to retain. The function of circular concave portions 26 and central retaining openings 28 will be described in detail below.

Case 10 is formed having a plurality of vertical walls 29 and upwardly projecting hollow columns 30 disposed within side walls 12, 14, 16, 18. In the embodiment of FIGS. 1–11 columns 30 do not extend to and do not contact the top surface of bottom portion 20. Vertical walls 29 do not extend to the top surface of bottom portion 20. The side edges of vertical walls 29 abut columns 30 and help to secure columns 30 to bottom portion 20. Verical walls 29 and columns 30, when combined with upper surface 22 of bottom portion 20 and sidewalls 12, 14, 16, 18, define a plurality of bottle retaining pockets 32. Columns 30 are hollow to permit vertical stacking of empty cases 10. Columns 30 extend above bottom portion 20 a distance approximately one third of the height of the bottles to be retained in case 10. This increases the effective height of the case while maintaining high bottle visibility and low manufacturing costs. For example, where cases 10 are shaped to retain 2-liter bottles, columns 30 extend upwardly approximately four inches. Columns 30 are disposed either along the walls 12, 14, 16, 18 or away from the walls, centrally within bottom portion 20. Columns 30 disposed in the corners between two adjacent walls have one curved surface 34. Columns 30 disposed on the sides of one of the walls have two curved surfaces 34 and one flat surface 36 disposed therebetween. The two curved surfaces 34 help define two separate and adjacent bottle retaining pockets 32. Flat surface 36 is disposed between these two bottle retaining pockets. Columns 30 that are disposed centrally within bottle portion 20 are octagonally shaped. These columns 30 have four alternating curved surfaces 34 and four alternating flat surfaces 36. The four curved surfaces 34 define portions of four bottle retaining pockets 32 and the four flat surfaces 36 separate these pockets. Four curved surfaces 34 on four separate columns 30 form the four corners of a bottle retaining pocket 32. Thus, column 30 having two curved surfaces 34 form a corner of two adjacent bottle retaining pockets 32, and columns 30 having four curved surfaces 34 form a corner of four adjacent bottle retaining pockets 32. As seen in FIG. 1, 2, 4 and 11, the columns disposed about a center line 17 of the length of the case include recesses 50 and 51 which extend downwardly to a height which substantially equals a side wall height. These recesses are for receiving a side wall of an identical upper case. As seen in FIGS. 1, 2, 4 and 11, the columns disposed about a centerline of the length of the case include recesses 50 and 51 which extend downwardly to a height which substantially equals a side wall for receiving a side wall of an identical upper crate.

The upper surface 22 of bottom portion 20 within bottle retaining pockets 32 is substantially flat. This permits retention of bottles regardless of the configuration of the bottom of the bottles. Also, this allows petaloid bottles to be rotated within the bottle retaining pockets to facilitate display of the product. The very low depth feature of case 10 further enhances product display.

Figure 2:
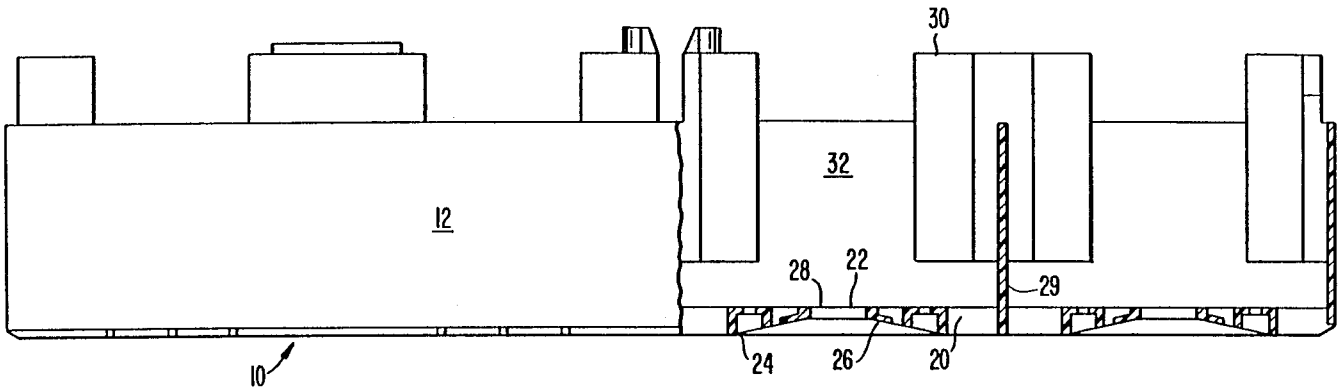
FIG. 2 is a side view, partially in section taken along line 2—2 of FIG. 4, of the case of FIG. 1.
Figure 3:
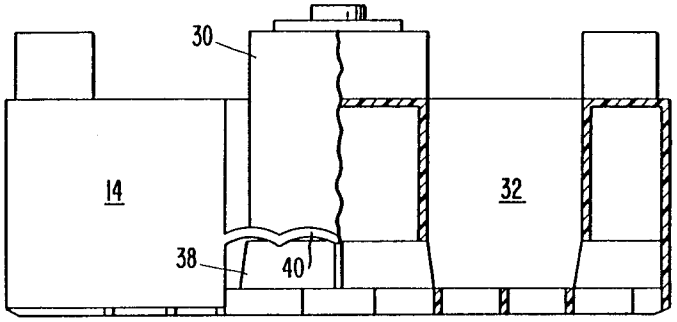
FIG. 3 is an end view, partially in section taken along line 3—3 of FIG. 4, of the case of FIG. 1.

The circular concave portions 26 of lower surface 24, shown clearly in FIG. 2, allow cases 10 filled with bottles to be vertically stacked for transportation, storage, amd display purposes. Circular concave portions 26 are formed of ribs or projections which define the circular concave shape. These ribs also form central retaining opening 28. Central retaining opening 28 is sized to receive the bottle top 9*a* of a bottle 9 which is disposed in a lower case 10 as shown in FIG. 9. Bottle top 9*a* fits adjacent central retaining opening 28 so that central retaining opening 28 retains bottle top 9*a* in position against lower surface 24. The concave shape of circular concave portion 26 assists bottle top 9*a* to abut central retaining opening 28. When an upper case 10 is being positioned on loaded lower case 10, often tops 9*a* will not precisely line up with respective central retaining openings 28. However, bottle 9*a* will contact circular concave portions 26 which, because of their concave shape, will guide bottle tops 9*a* into central retaining openings 28. Additionally, the center-to-center distances between adjacent bottle retaining pockets within one case are substantially equal. Similarly, the center-to-center distances between adjacent bottle retaining pockets in adjacent cases with abutting side walls is substantially equal.

A plurality of empty cases 10 may also be stably stacked on top surfaces 12', 14', 16' and 18' of each other. Because columns 30 are hollow, in one embodiment, at least a portion of column 30 in a lower case 10 may be disposed within a portion of a respective column 30 in an upper case 10. This permits a stable male-female type interlocking. This stacking arrangement can be performed with the embodiment of case 10 illusrated in FIGS. 12–16.

Figure 10:
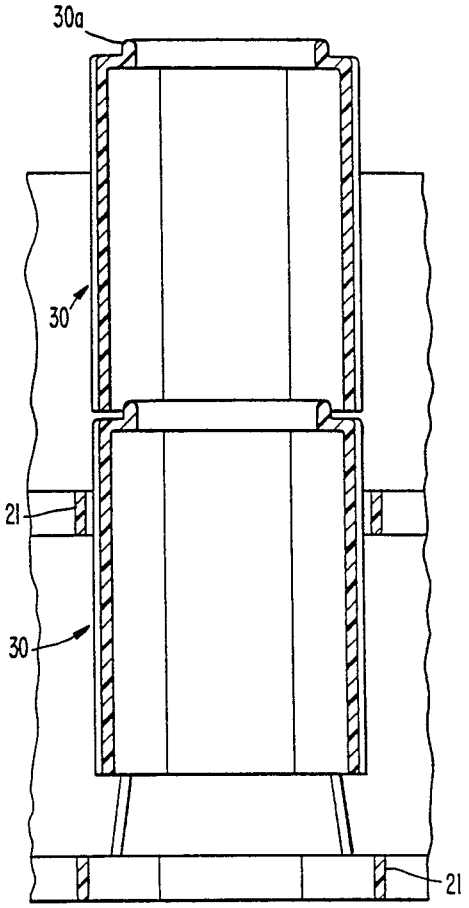
FIG. 10 is a sectional view similar to that of FIG. 6, which is taken along line 6—6 of FIG. 4, showing two empty stacked cases.
Figure 11:
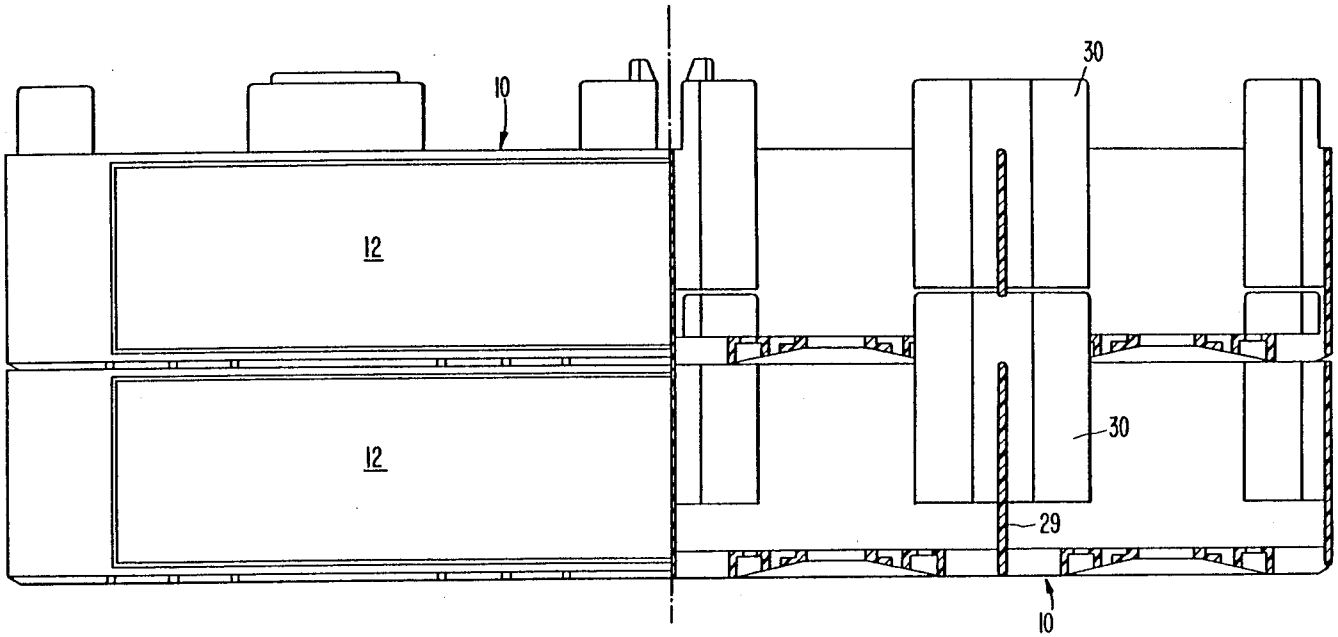
FIG. 11 is a sectional view similar to that of FIG. 2, which is taken along line 2—2 of FIG. 4, showing a side view of two empty stacked cases.
Figure 12:
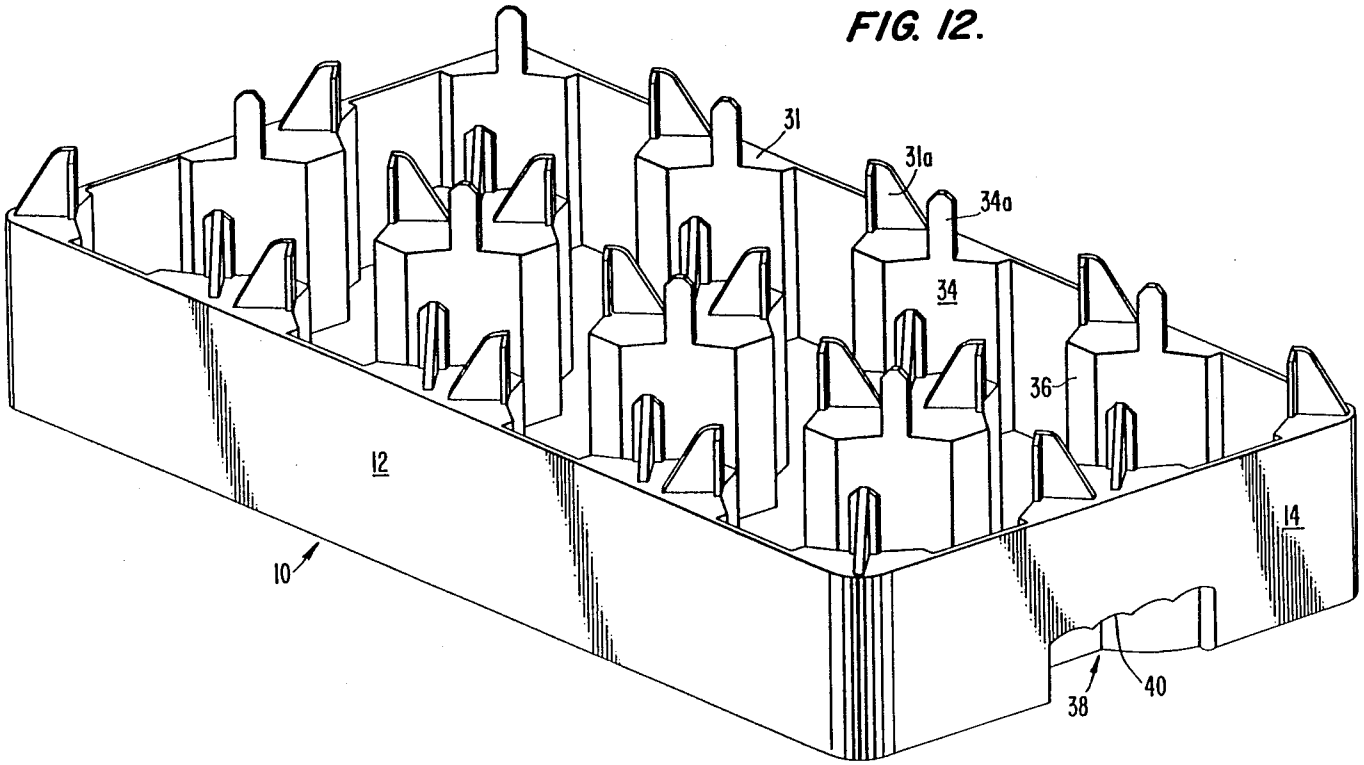
FIG. 12 is a perspective view of a stackable low depth case according to another embodiment of the present invention.
Figure 13:
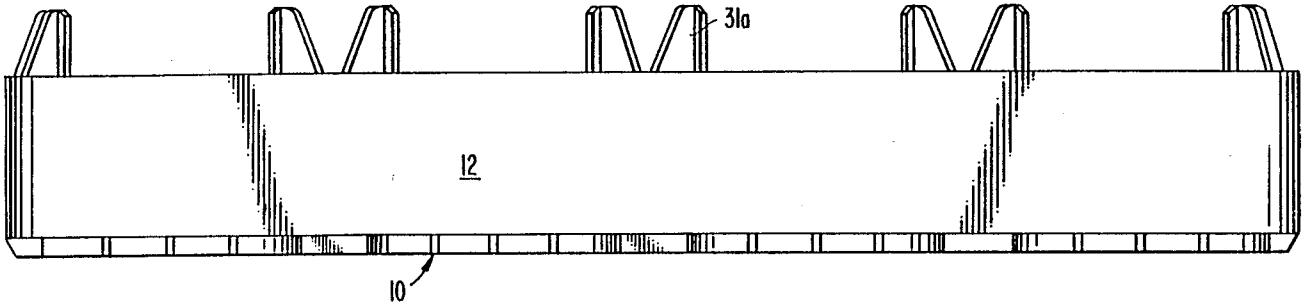
FIG. 13 is a side view of the case of FIG. 12.
Figure 14:
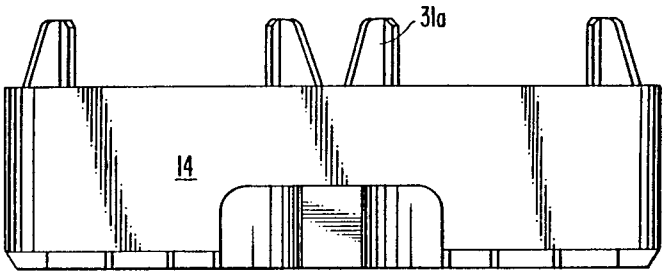
FIG. 14 is an end view of the case of FIG. 12 having a different handle portion.
Figure 15:
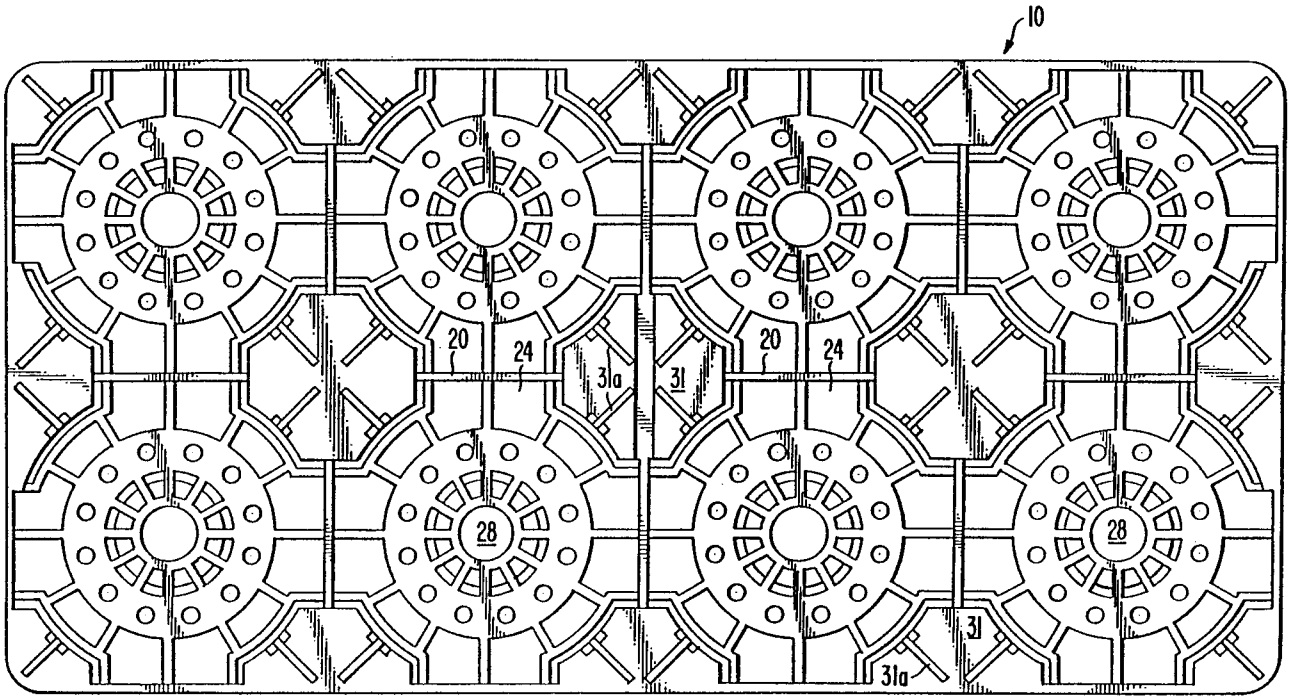
FIG. 15 is a top view of the case of FIG. 12.
Figure 16:
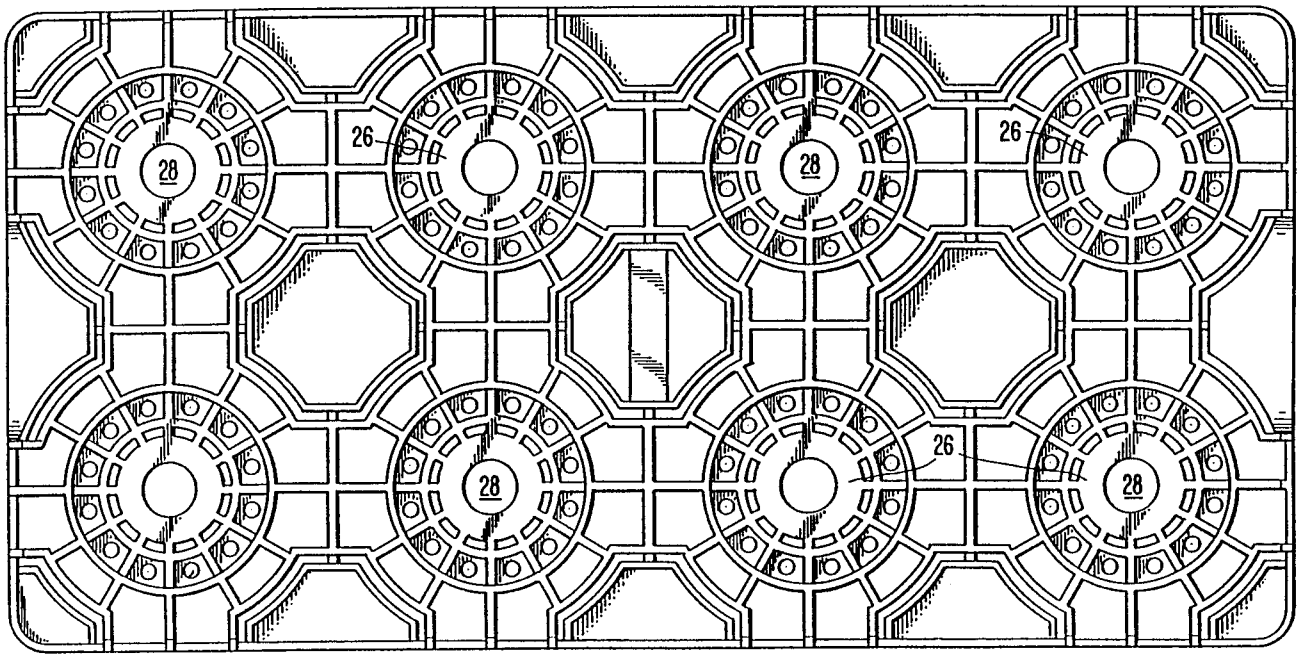
FIG. 16 is a bottom view of the case of FIG. 12.
Figure 1:
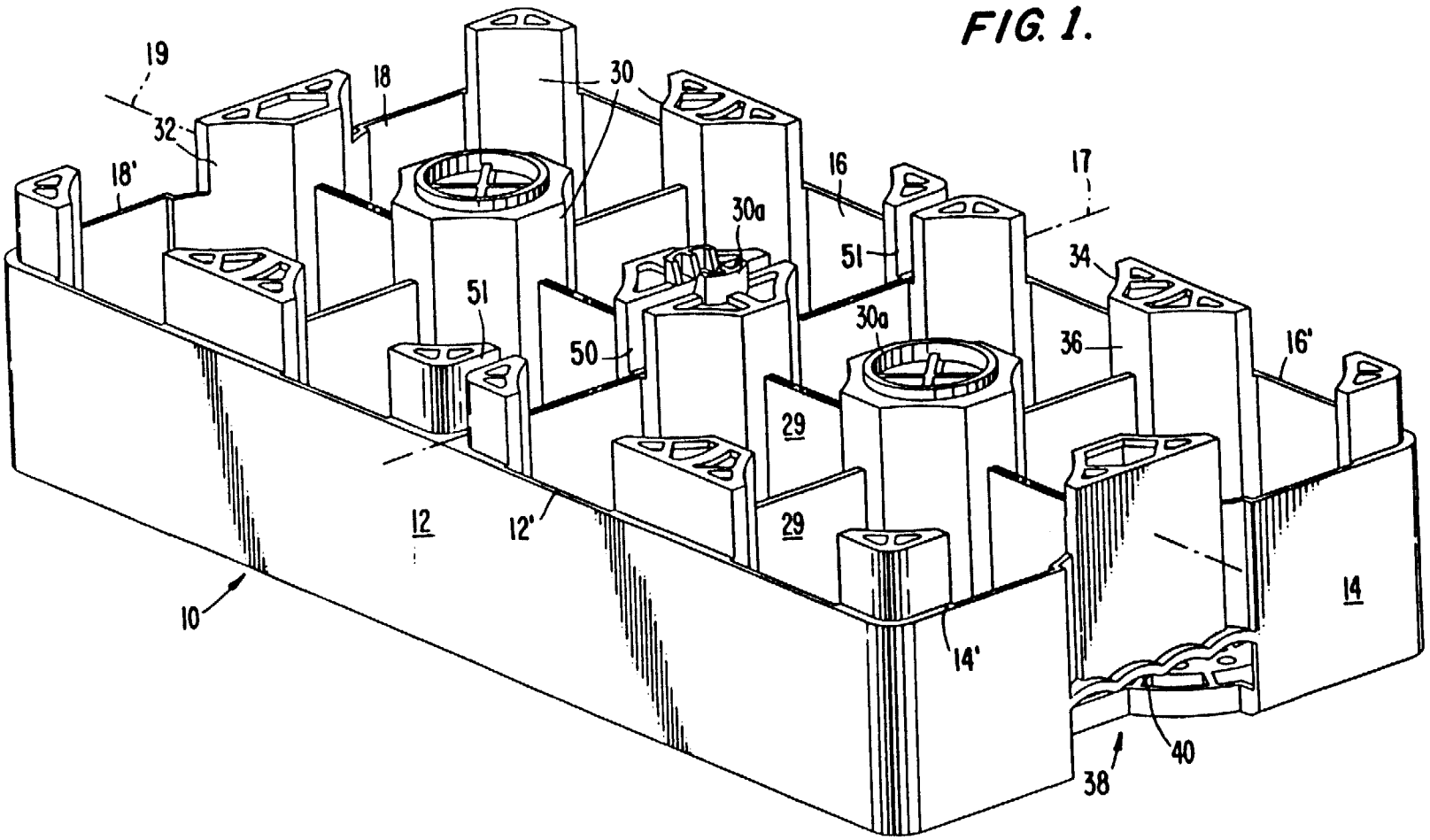
Figure 2:
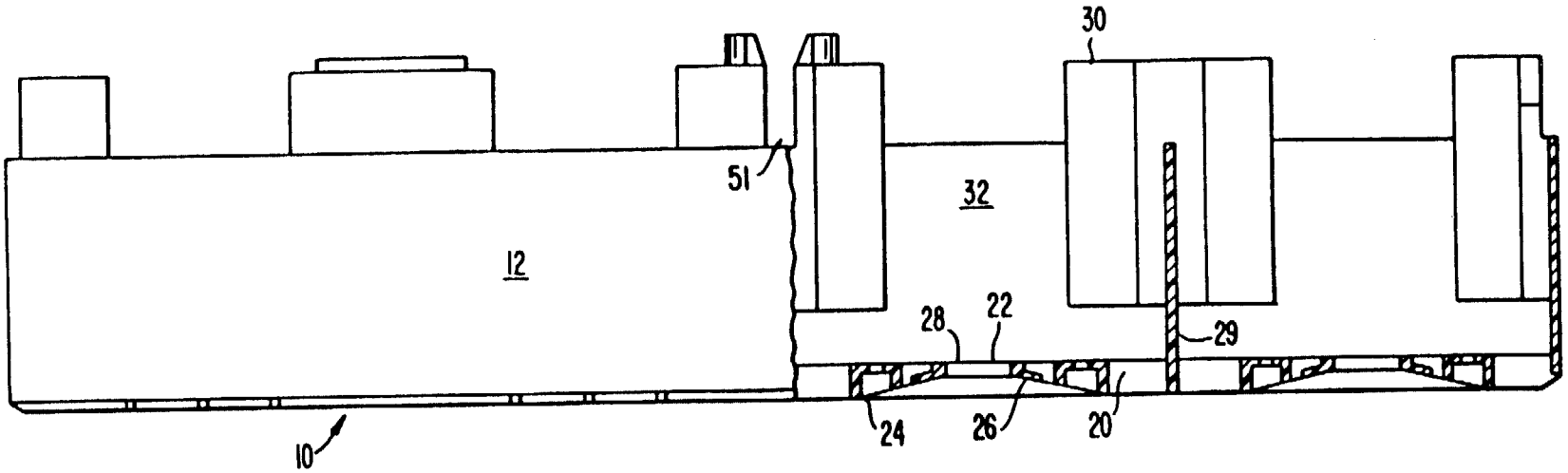
Figure 3:
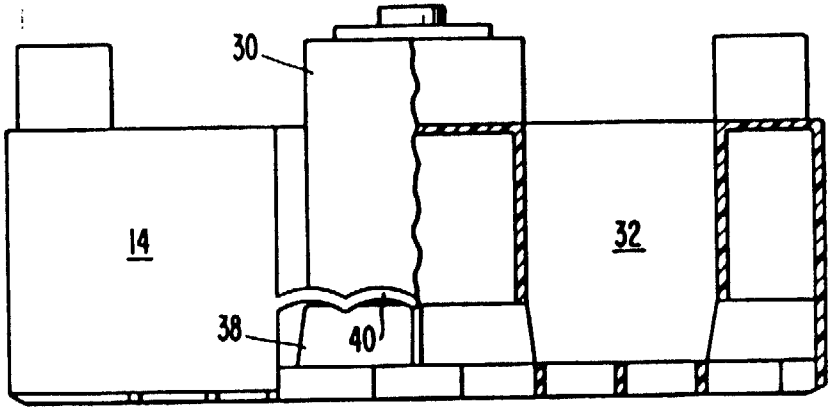
Figure 4:
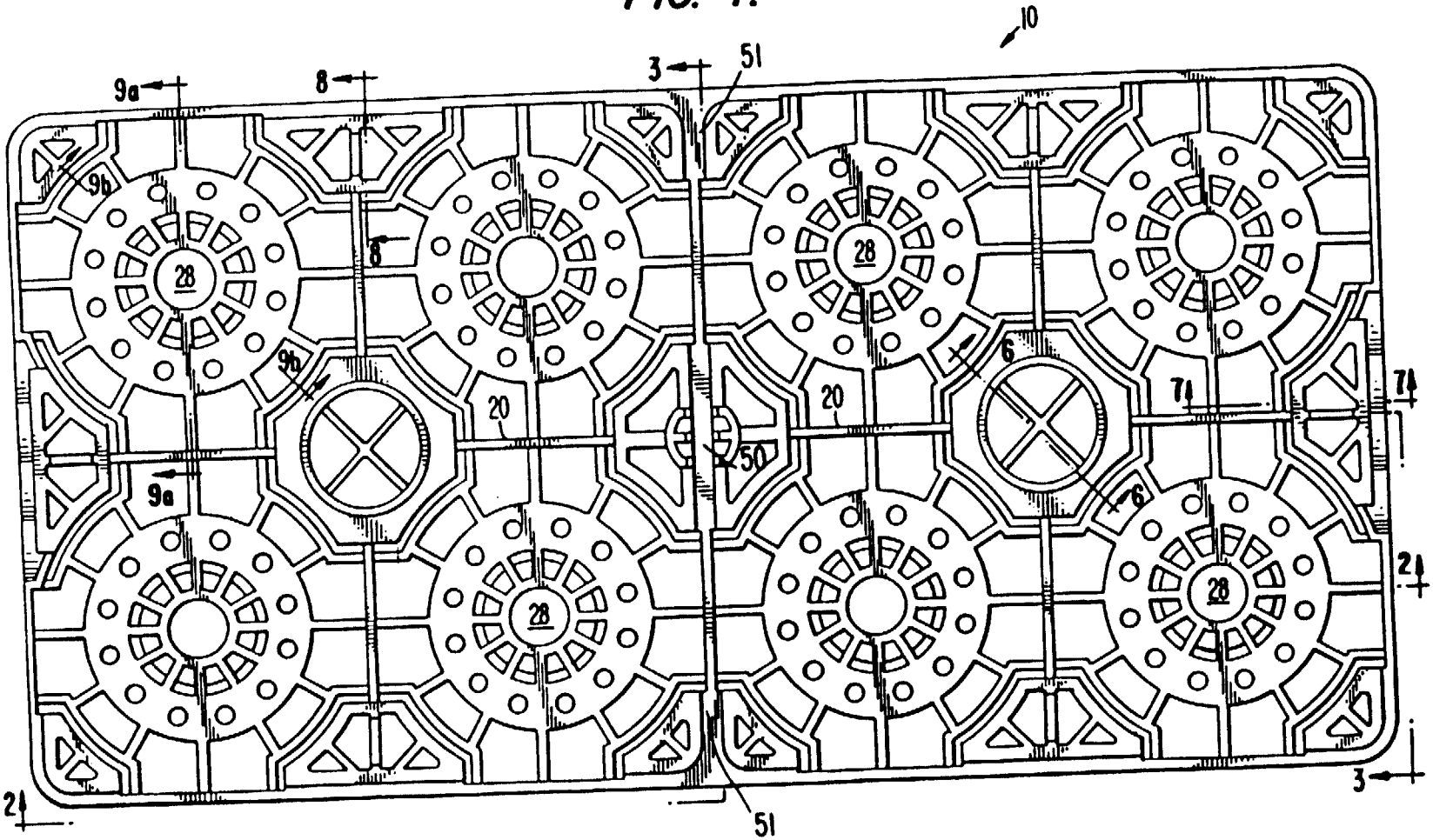
Figure 5:
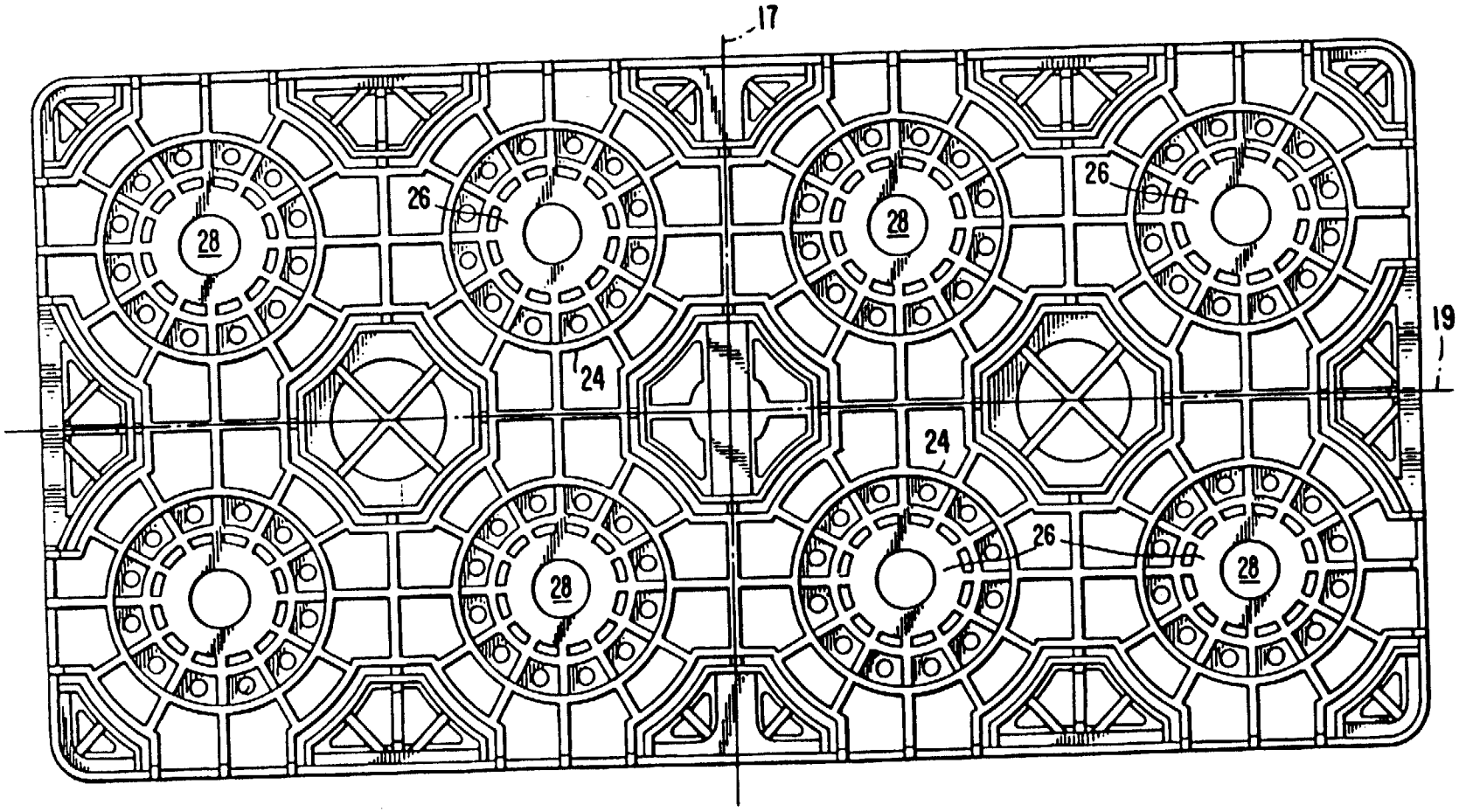
Figure 6:
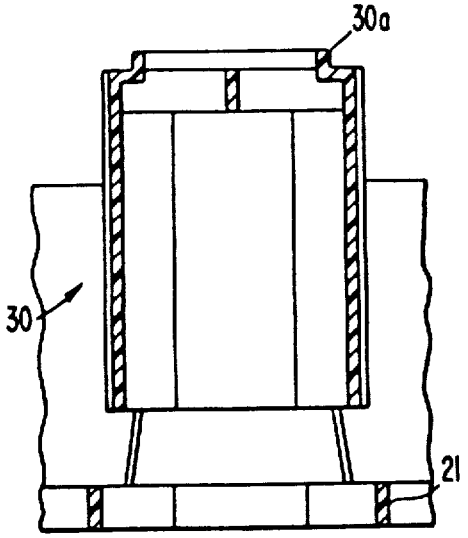
Figure 7:
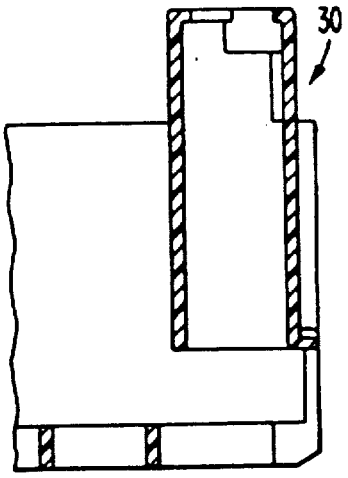
Figure 8:
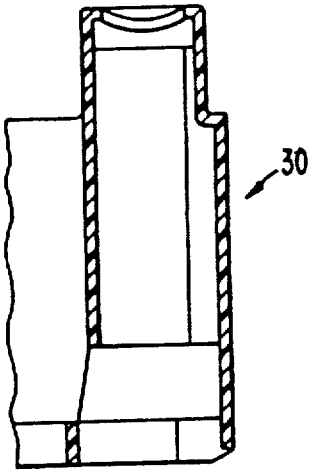
Figure 9B:
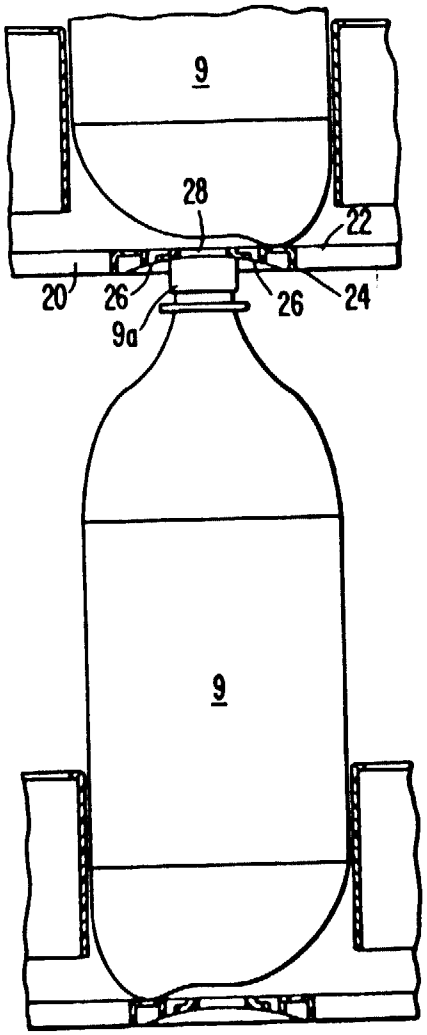
Figure 9A:
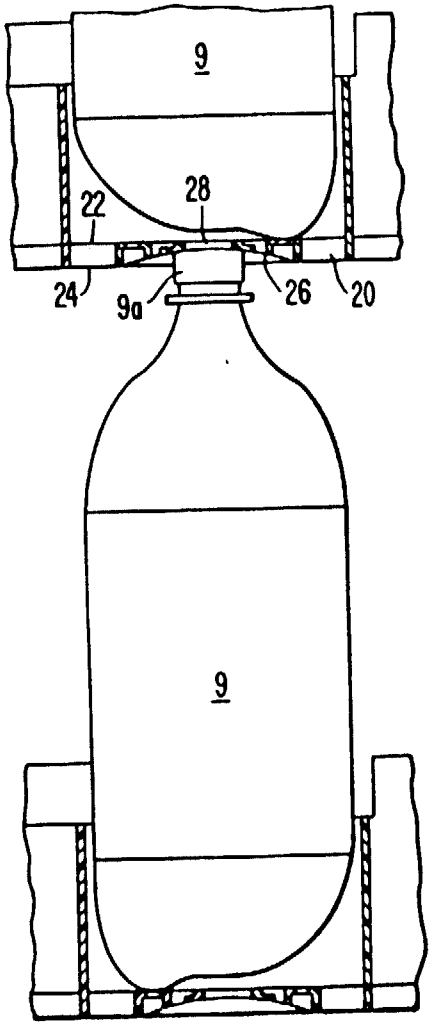
Figure 10:
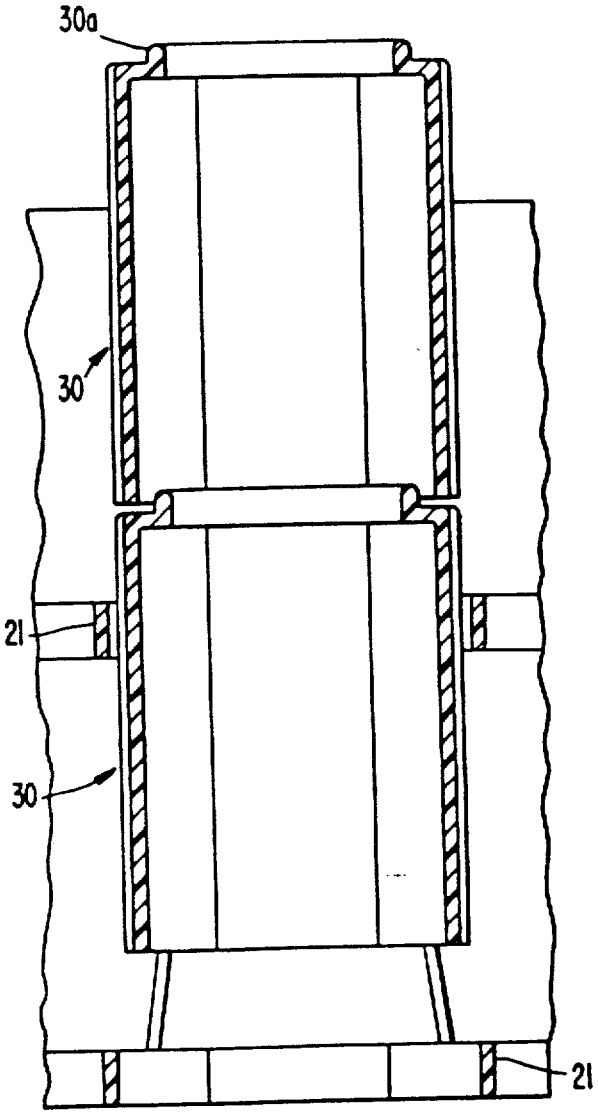
Figure 11:
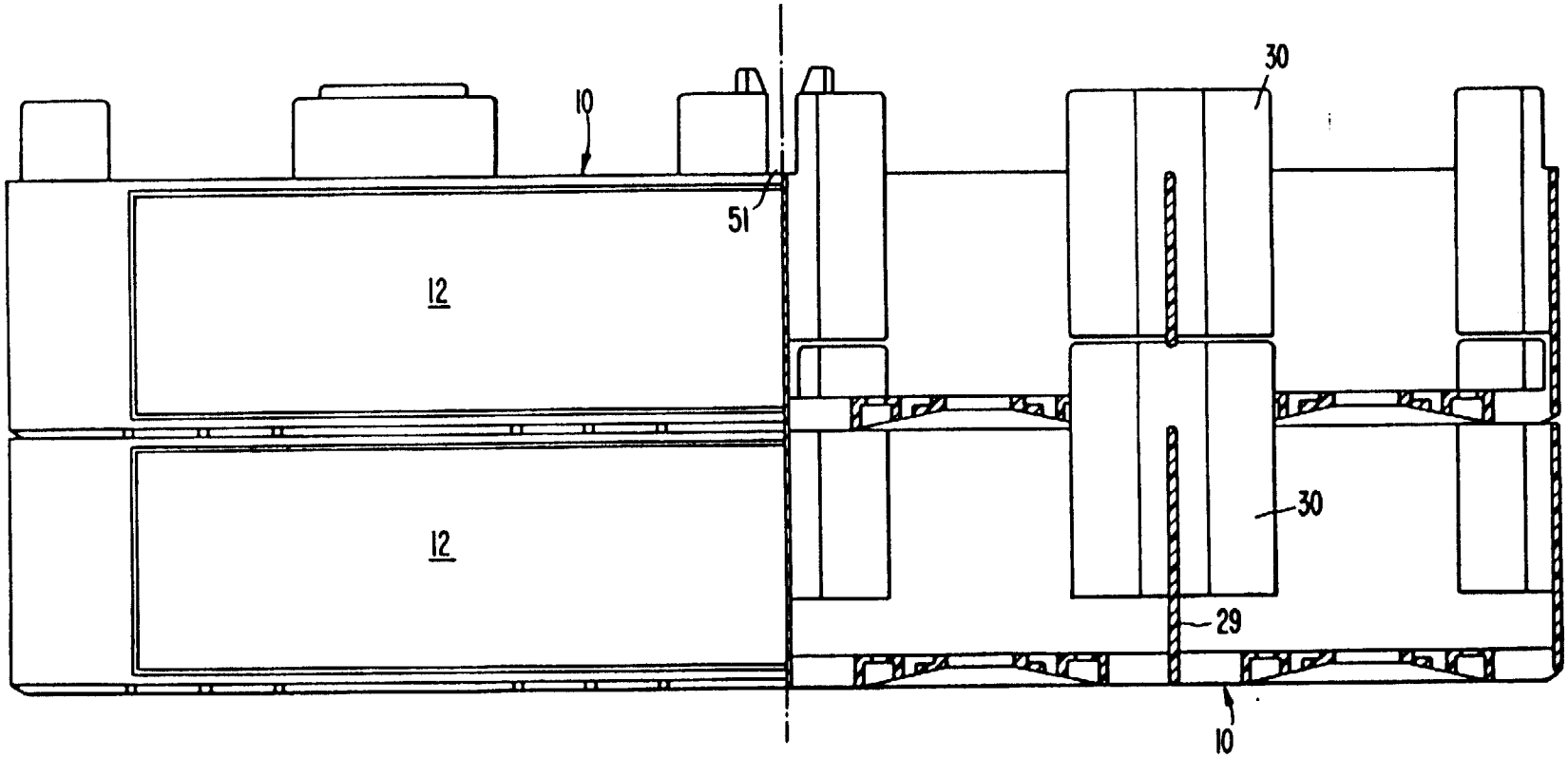
Figure 12:
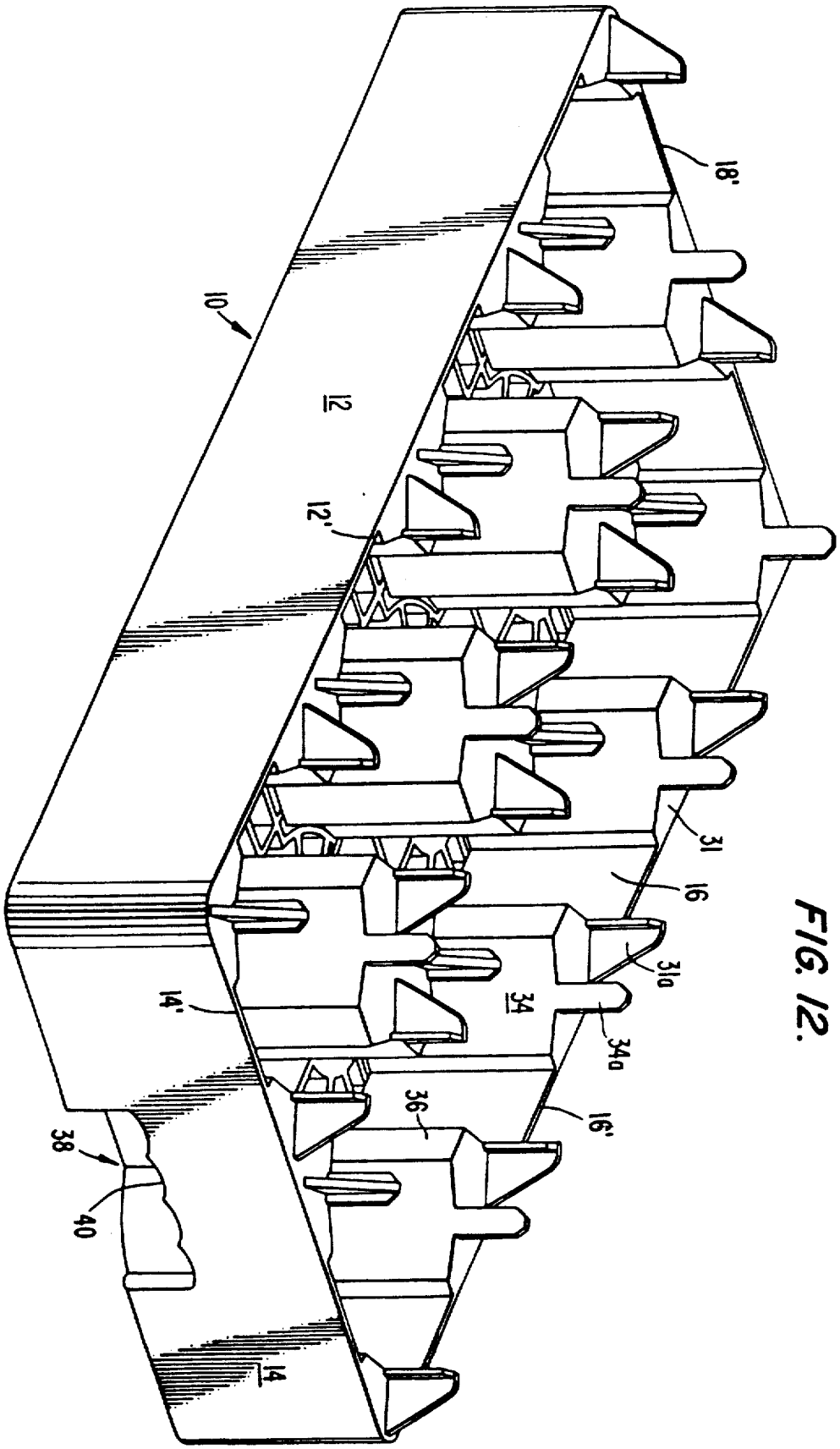
Figure 13:
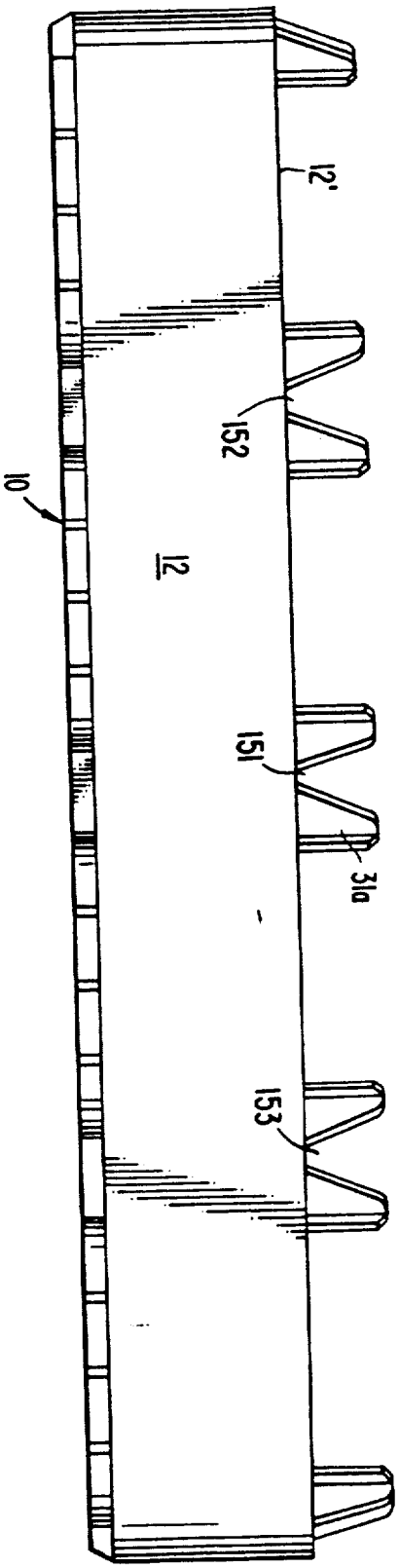
Figure 14:
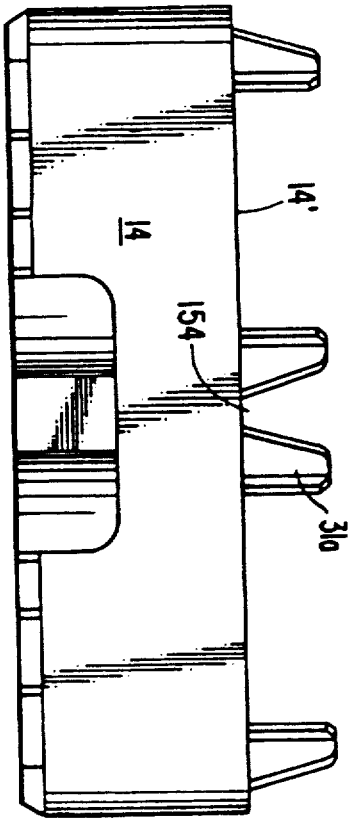
Figure 15:
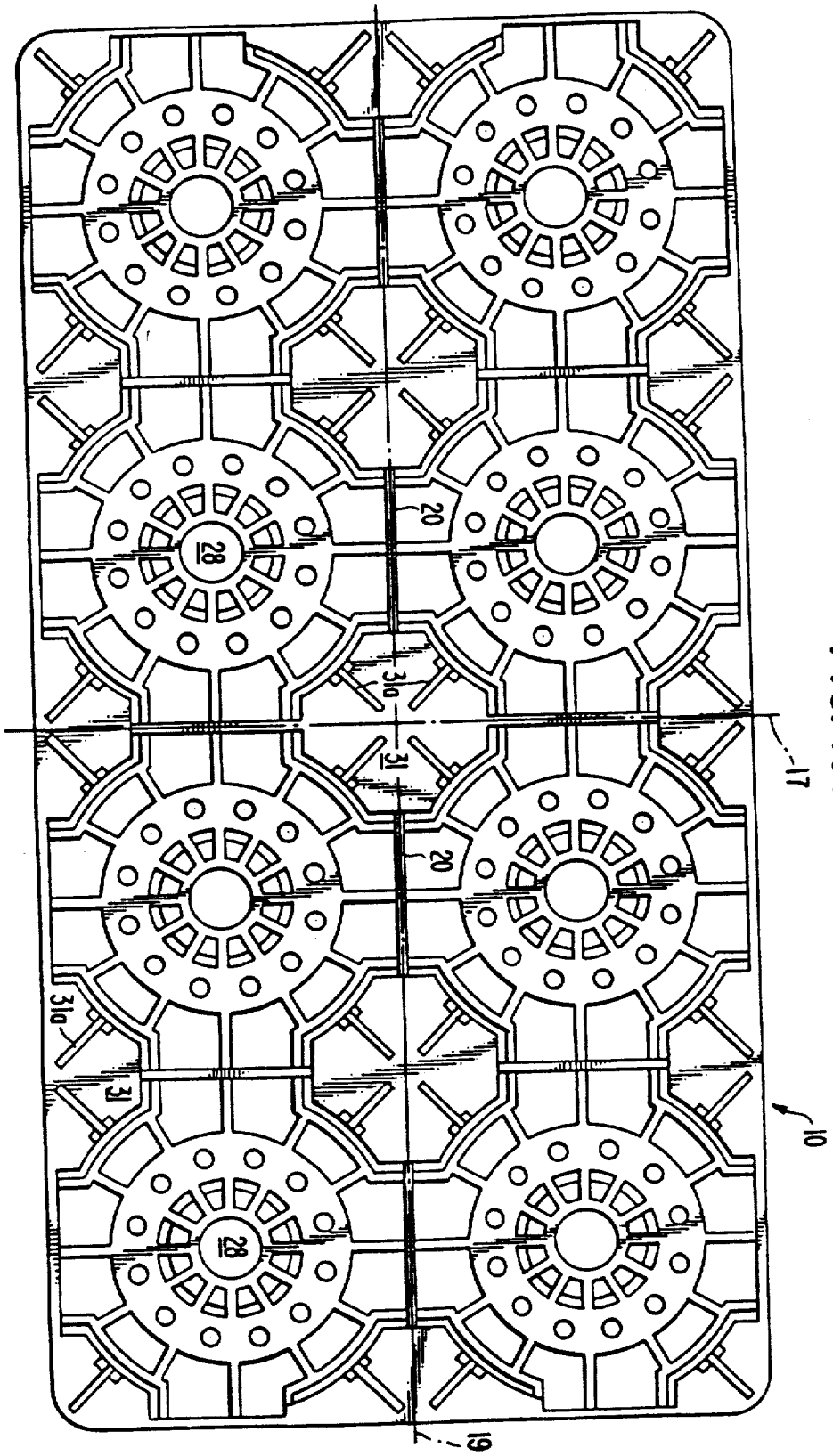
Figure 16:
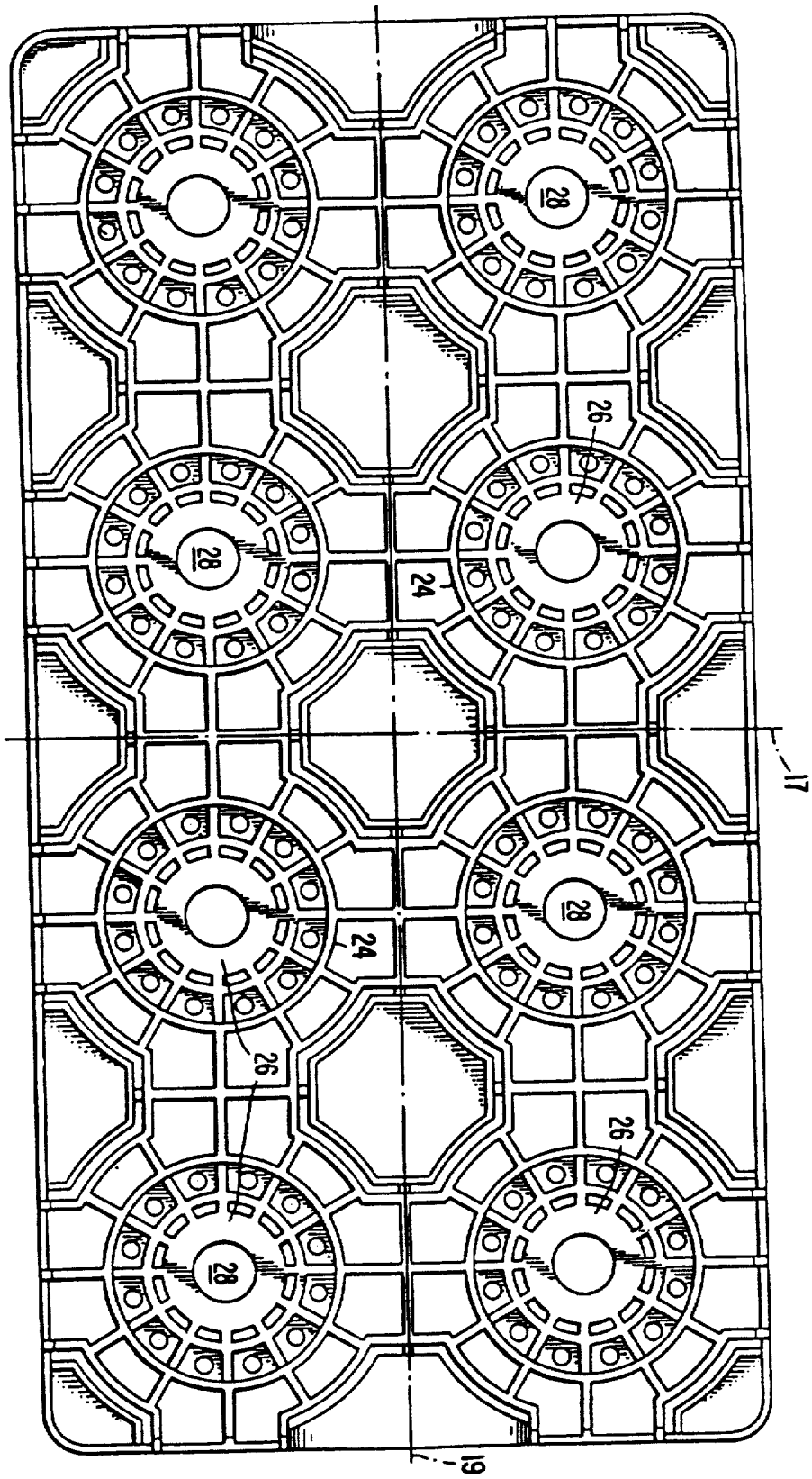

In the embodiment of FIGS. 1–11, a slightly different interlocking of empty stacked cases 10 occurs. As best illustrated in FIGS. 2, 3, 6, 7, 8, and 11, columns 30 do not extend to bottom portion 20. There is a gap between bottom portion 20 and the bottom of columns 30. This configuration allows empty cases of the FIG. 1 embodiment to stack vertically without having the lower portion of columns 30 taper outwardly to receive columns 30 of a lower case 10. As shown in FIGS. 10 and 11, two empty cases 10 are stacked vertically. The top portions of columns 30 of the lower case do not extend into columns 30 of the upper case. Only projecting portion 30*a* of a lower column 30, shown in FIG. 10, which is disposed only on some columns 30 as described below, enters an upper column 30. Lower columns 30 fit within ribs located on bottom portion 20 of case 10 and corresponding to respective columns 30. The interlocking of columns 30 within ribs 21 securely and stably connects empty stacked cases 10.

Side walls 14, 18, are formed with handle portions 38 to facilitate carrying case 10. Preferably, handle portions 38 have finger recesses 40 to further aid carrying case 10. In one preferred embodiment, some columns 30 may have slightly different heights than the remaining columns 30. In FIG. 1, the central columns 30 have projecting portions 30*a* which extend above the other columns 30. This causes cases 10 to wobble when placed upside down on a flat surface and prevents cases 10 from being used upside down merely as stacking boxes to stack other items. In FIG. 2, one of projecting portions 30*a* is not shown to provide a better illustration for FIG. 11.

FIGS. 12–16 illustrate an alternate embodiment of the stackable low depth case of the present invention. In this embodiment, the shape and construction of columns 30 differs from that of the first embodiment. Also, vertical walls 29 are not used. The remaining features of the case are otherwise the same.

In this embodiment, columns 30 are formed with horizontal platforms 31 located at a level substantially coplanar with the top of side walls 12, 14, 16, 18. Projections 31*a* are disposed on platforms 31. Projections 31*a* include a substantially triangular or wedge-shaped support portion and have curved surfaces 34*a* extending from curved surfaces of columns 30. Curved surfaces 34*a* are narrower than curved surfaces to decrease the weight and bulk of the case and curved surfaces 34*a* lie in the same plane as respective curved surfaces 34. The wedge-shaped portion of projections 31*a* are substantially perpendicular to curved surfaces 34*a*. When empty cases of this embodiment are stacked top to bottom, projections 31*a* of a lower case may fit within the openings of respective column 30 of an adjacent upper case if columns 30 extend to the top surface of bottom portion 20.

Numerous characteristics, advanatges, and embodiments of the invention has been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. A cross-stacking case for retaining and transporting bottles comprising:

outer side walls forming an outer shell;

a case bottom disposed substantially within said outer shell;

a plurality of means for supporting outer surfaces of bottles, generally disposed within said outer shell and each supporting means having at least one bottle supporting surface, said bottle supporting surfaces defining, in combination wtih said outer shell and said case bottom, a plurality of bottle retaining pockets with at least one bottle supporting means associated with each pocket; and receiving means, generally disposed within said outer shell, extending above the height of a top surface of a first of said side walls and having a recess, for receiving a side wall of an upper identical case when said lower cross-stacking case is empty.

2. A case as in claim 1, wherein said recess extends downwardly in said receiving means to the height of the top of said first side wall.

3. A case as in claim 1, wherein each of said plurality of bottle supporting means defines a column and said receiving means is associated with one of said columns.

4. A case as in when claim 3, wherein said columns are hollow and when said case is empty said receiving means interblocks within a hollow portion of a column on an identical upper case.

5. A case as in claim 1, wherein said outer side walls form a rectangular shell having a longer length than width and having a center line of the width of the case extending through the center of the shorter of a pair of side walls of the case; and said receiving means is disposed about the center line of the width of said case and said recess of said receiving means extends along the center line of the width of the case.

6. A case as in claim 1, wherein said bottle supporting surfaces are shaped to support 2-liter PET bottles;

said case bottom includes:

an upper surface which is substantially flat across the bottle retaining pockets; and a lower surface; and said plurality of bottle supporting means extends above said lower surface of said case bottom a distance of approximately one-third the height of the 2-liter PET bottles to be retained and transported.

7. A case as in claim 6, wherein said case bottom lower surface includes means for resting the case bottom on closures of 2-liter PET bottles in a subjacent case and for aligning each closure with said case bottom for stacking said case.

8. A case as in claim 1, wherein at least one of said bottle supporting means can be associated with more than one of said pockets.

9. A case as in claim 1, wherein said receiving means extends above the height of a top surface of each of said side walls.

10. A case as in claim 1, wherein said side walls are less than half the height of the stored bottles.

11. A cross-stacking case for retaining and transporting bottles comprising:

outer side walls forming an outer shell;

a case bottom diposed substantially within said outer shell;

a plurality of means for supporting outer surfaces of bottles, generally disposed within said outer shell and each supporting means having at least one bottle supporting surface, said bottle supporting surfaces defining, in combination with the outer shell and the case bottom, a plurality of bottle retaining pockets with at least one bottle supporting means associated with each pocket; and a plurality of receiving means, generally disposed within said outer shell, extending above the height of a top surface of a first of said side walls and each of said means having a recess, for receiving a side wall of an upper identical case when said lower cross-stacking case is empty.

12. The stackable case as in claim 11, wherein said four side walls form a rectangular shape, having a longer length than width and having a center line of the length of the case extending through the longer pair of side walls of the case; and each of said recesses of said plurality of supporting means are aligned parallel to the center line of the length of the case.

13. The case as in claim 12, wherein each of said recesses extend downardly to the height of the top of said first side wall.

14. The case as in claim 11, wherein each of said recesses extend downwardly to the height of the top of said first side wall.

15. The case as in claim 11, wherein one of said recesses of one of said receiving means extend along the center line of the length of the case.

16. A case as in claim 11, wherein each of said bottle supporting means further comprise a horizontal platform disposed substantially coplanar with the height of a top surface of said first side wall.

17. A case as in claim 16, wherein each of said receiving means comprise a plurality of upwardly disposed projections extending from said platforms of said bottle supporting means and below a top surface of the retained bottles.

18. A case as in claim 17, wherein each of said bottle supporting surfaces are coplanar with one of said projections and said coplanar surfaces are curved to substantially conform to the shape of the bottle to be retained and transported in said bottle retaining pockets.

19. A case as in claim 17, wherein said projections include wedge-shaped support portions.

20. A case as in claim 11, wherein at least one of said bottle supporting means can be associated with more than one of said pockets.

21. A case as in claim 11, wherein each of said receiving means extend above the height of a top surface of each of said side walls.

22. A case as in claim 11, wherein said side walls are less than half the height of the stored bottles.

23. A cross-stacking case for retaining and transporting bottles comprising:

four outer side walls forming a rectangular outer shell having a ratio of the length to the width of the outer shell be substantially equal to the number of bottles said case holds in the lengthwise direction to the number of bottles said case holds in the widthwise direction;

a case bottom disposed substantially within said outer shell; and a plurality of means for supporting outer surfaces of bottles, generally disposed within said outer shell and each supporting means having at least one bottle supporting surface, said bottle supporting surfaces defining, in combination with the outer shell and the case bottom, a plurality of bottle retaining pockets, with at least one bottle supporting means associated with each pocket;

wherein a first of said plurality of bottle supporting means is disposed above the height of a top surface of a first of said side walls and has a recess for receiving a side wall of an upper identical case when said lower cross-stacking case is empty.

24. A case as in claim 23, wherein said recess extends downwardly to the height of the top of said first side wall.

25. A case as in claim 23, wherein the upper identical case is disposed at 90° to said lower cross-stacking empty case.

26. A case as in claim 23, wherein the center-to-center distance between adjacent bottle retaning pockets within said case and between two adjacent cases having abutting side walls are substantially equal.

27. A case as in claim 23, wherein said first of said bottle supporting means extends above a topmost poitn of the other of said plurality of bottle supporting means.

28. A case as in claim 23, wherein at least one of said bottle supporting means can be associated with more than one of said pockets.

29. A case as in claim 23, wherein said first bottle supporting means extends above the height of a top surface of each of said side walls.

30. A case as in claim 23, wherein said side walls are less than half the height of the stored bottle.

31. A cross-stacking low depth case for retaining and transporting bottles comprising:

four outer side walls forming a rectangular outer shell having the ratio of the length to the width of said outer shell be substantially equal to the number of bottles said case holds in the lengthwise directions to the number of bottles said case holds in the widthwise direction and having a center line of the length of the case extending through the center of the longer pair of side walls of the case;

a case bottom disposed substantially with said outer shell; and a plurality of supporting means for supporting outer surfaces of bottles, generally disposed within said outer shell and each supporting means having at least one bottle supporting surface, said bottle supporting surfaces defining, in combination with said outer shell and saud case bottom, bottle retaining poskets, with at least one bottle supporting means associated with each pocket;

wherein a first of said plurality of bottle supporting means is disposed about the center line of the length of the case and includes a portion extending above the height of a top surface of a first of said side walls, said portion above the height of said first side walls includes a recess which extends along the center line of the length of the case.

32. A low depth case as in claim 31, wherein:

said outer shell has a center line of the width of the case extending through the center of the shorted pair of side walls of the case;

said first bottle supporting means is also disposed about the center line of the width of the case; and a second and third of said pluraliyt of bottle supporting means are disposed about the center line of the width of said case, include a portion extending above the height of a top surface of said first side wall, and include a recess within said portion with each of said recesses extending parallel to the center line of the length of said case.

33. A low depth case as in claim 31, wherein said first bottle supporting means further comprises a horizontal platform disposed substantially coplanar with the height of said top surface of said first side wall.

34. A low depth case as in claim 33, wherein said portion of said first bottle supporting means which extends above the height of said first side wall comprises a plurality of upwardly disposed projections extending from said platform and below a top surface of the retained bottles.

35. A low depth case as in claim 34, wherein said bottle supporting surface of said first bottle supporting means is coplanar with one of said projections and said coplanar surface is curved to substantially conform to the shape of a bottle to be retained and transported in said case.

36. A low depth case as in claim 34, wherein said projections include wedge-shaped support portions.

37. A low depth case as in claim 31, wherein at least one of said bottle supporting means can be associated with more than one of said pockets.

38. A low depth case as in claim 31, wherein said recess extends downwardly to the height of the top of said first side wall.

39. A low depth case as in claim 31, wherein said first bottle supporting means is disposed above the height of a top surface of each of said side walls.

40. The case as in claim 1, wherein said recess of said receiving means extends along the center line of the length of the case.

41. The case as in claim 1, wherein said receiving means is disposed away from and not in contact with said outer side walls.

42. The case as in claim 1, wherein said bottle supporting means further comprise a horizontal platform disposed substantially coplanar with the height of a top surface of said first side wall.

43. A case as in claim 42, wherein said receiving means comprises a plurality of upwardly disposed projections extending from said platform of said bottle supporting means and below a top surface of the retained bottles.

44. The case as in claim 1, wherein each of said bottle supporting surfaces are curved to substantially conform to the shape of the bottles to be retained and transported in said bottle retaining pockets, said receiving means extends from one of said bottle supporting means and said receiving means is disposed inward from said bottle supporting surface of said bottle supporting means.

45. A case as in claim 3, wherein said receiving means is disposed inward from said bottle supporting surface of said column.

46. The case as in claim 7, whereins the ratio of the length to the width of said outer shell is substantially equal to the ratio of the number of bottles said case holds in the lengthwise direction to the number of bottles said case holds in the widthwise direction so that a plurality of said cases may be cross stacked, wherein at least some of said cases in one layer can be disposed at 90° angles from cases in adjacent layers and the center-to-center distance between adjacent bottle retaining pockets within said case and between two adjacent cases having abutting side walls are substantially equal.

47. The case as in claim 12, wherein each of said recesses are disposed along the center line of the length of the case.

48. The case as is claim 11, wherein:

said side walls are less than half the height of the stored bottles;

said bottle supporting surfaces are shaped to support 2-liter PET bottles; and said case bottom includes an upper surface which is substantially flat across the bottle retaining pockets.

49. The case as in claim 48, wherein said case bottom further comprises a lower surface having means for resting the case bottom on closures of 2-liter PET bottles in a subjacent case and for aligning each closure with said case bottom for stacking said case.

50. The case as in claim 49, wherein the ratio of the length to the width of said outer shell is substantially equal to the ratio of the number of bottles said case holds in the lengthwise direction to the number of bottles said case holds in the widthwise direction so that a plurality of said cases may be cross stacked, wherein at least some of said cases in one layer can be disposed at 90° angles from cases in adjacent layers and the center-to-center distance between adjacent bottle retaining pockets with said case and between two adjacent cases having abutting side walls are substantiall equal.

51. The case as in claim 48, wherein the ratio of the length to the width of said outer shell is substantially equal to the ratio of the number of bottles said case holds in the lengthwise direction to the number of bottles said case holds in the widthwise direction so that a plurality of said cases may be cross stacked, wherein at least some of said cases on one layer can be disposed at 90° angles from cases in adjacent layers and the center-to-center distance between adjacent bottle retaining pockets with said case and between two adjacent cases having abutting side walls are substantially equal.

52. The case as in claim 48, wherein said plurality of bottle supporting means extend above said lower surface of said case bottom a distance of approximately one-third the height of the 2-liter PET bottles to be retained and transported.

53. The case as in claim 11, wherein said plurality of receiving means are disposed away from said outer side walls.

54. The case as in claim 29, wherein said first bottle supporting means further comprises:

a horizontal platform disposed substantially coplanar with the height of a top surface of said side walls;

a 2-liter PET bottle supporting surface extending no higher than said horizontal platform; and a plurality of upwardly disposed projections extending upward from said platform of said first bottle supporting means, deifining said recess, diposed inward from said bottle supporting surface, and below a top surface of the retained bottles.

55. The case as in claim 23, wherein said recess of said first bottle supporting means is disposed along the center line of the length of the case.

56. The case as in claim 23, wherein said first bottle supporting means further comprises:

a horizontal platform disposed substantially coplanar with the height of a top surface of said first side wall;

a 2-liter PET bottle supporting surface extending no higher than said horizontal platform; and a plurality of upwardly disposed projections extending upward from said platform of said first bottle supporting means, defining said recess, disposed inward from said bottle supporting surface, and below a top surface of the retained bottles.

57. The cae as in claim 31, wherein said outer shell as a center line of the width of the case extending through the center of the shorter pair of side walls of the case;

said first bottle supporting means is also disposed about the center line of the width of the case; and said first bottle supporting means portion extending above the height of said first side wall is disposed inward from said bottle supporting surfaces in said first bottle supporting means.

58. The case as in claim 31, wherein said bottle supporting surfaces are shaped to conform to the shape of 2-liter PET bottles.

59. The case as in claim 58, wherein said case bottom includes an upper surface which is substantially flat across the bottle retaining pockets.

60. The case as in claim 59, wherein said case bottom includes means for resting the case bottom on closures of 2-liter PET bottles in a subsequent case and for aligning each closure with said case bottom for stacking said case.

61. A low depth case comprising:

outer side walls forming an outer shell wherein top edges of said side walls define a top surface of the outer shell;

a case bottom disposed substantially within said outer shell;

a plurality of means for supporting outer surfaces of bottles, generally disposed within said outer shell and each supporting means having at least one bottle supporting surface, said bottle supporting surfaces defining, in combination with said outer shell and said case bottom, a plurality retaining pockets with at least one bottle supporting means associated with each pocket; and receiving means, disposed within said outer shell, about a center line of the length of the case and above the height of the top surface of the outer shell of the case, which, when said case is empty, is for receiving a side wall of an upper identical case.

62. The low depth case an in claim 61, wherein said bottle supporting surfaces of said bottle supporting means do not extend above the top surface of said outer shell.

63. The low depth case as in claim 61, wherein the center line of the length of the case extends through the center of the longer pair of side walls of the case and said receiving means is disposes about the center line of the length of the case.

64. The low depth case as in claim 63, wherein said receiving comprises a plurality of projections which define a slot, said slot includes a bottom which is no higher than the top surface of the outer shell and the distance from a lowermost point of the case bottom to a top of the projections is no more than one-half the height of the bottles to be retained.

65. A low depth case comprising:

outer side walls forming an outer shell wherein top edges of said side walls define a top surface of the outer shell;

a case bottom disposed substantially within said outer shell;

a plurality of means for supporting outer surfaces of bottles, generally disposed within said outer shell and each supporting means having at least one bottle supporting surface, said bottle supporting surfaces defining, in combination with the outer shell and the case bottom, a plurality of bottle retaining pockets with at least one bottle supporting means associated with each pocket; and projections extending above said bottle supporting means and above the top surface of said outer shell, said projections to define slots which interlock with a side wall of an identical upper case for cross-stacking the identical upper case onto the lower low depth case when the lower low depth case is empty of bottles.

66. The case as in claim 65, wherein each slot is defined by two of said projections.

67. The case as in claim 65, wherein:

said outer shell has a center line of the length of the case extending through the center of the longer pair of side walls of the case;

a first of said bottle supporting means is disposed about the center line of the length of the case; and at least one of said slots is disposed about the center line of the length of the case.

68. The case as in claim 65, wherein:

said bottle supporting surfaces are curved to substantially conform to the shape of 2-liter PET bottles to be retained and transported in said bottle retaining pockets; and said case bottom includes an upper surface which is substantially flat acros the bottle retaining pockets.

69. A low depth case for retaining and transposrting 2-liter PET bottles comprising:

four outer side walls forming a rectangular outer shell wherein top edges of said side walls define a top surface of the outer shell and having a ratio of the length to the width of the outer shell be substantially equal to the number of bottles said case holds in the lengthwise direction to the number of bottles said case holds in the widthwise direction so that a plurality of said cases may be cross stacked, wherein at least some of said cases in one layer can be disposed at 90° angles from cases in adjacent layers and the center-to-center distance between adjacent bottle retaining pockets within said case and between two adjacent cases having abutting side walls are substantially equal;

a case bottom disposed substantially within said outer shell and including:

an upper surface which is substantially flat across the bottle retaining pockets; and a lower surface having means for resting the case bottom on closures of 2-liter PET bottles in a subjacent case and for aligning each closure wtih said case bottom for stacking said case; and a plurality of means for supporting outer surfaces of bottles, generally disposed within said outer shell and each supporting means having at least one bottle supporting surface, said bottle supporting surfaces defining, in combination with the outer shell and said case bottom upper surface, a plurality of bottle retaining pockets, with at least one bottle supporting means associated with each pocket and each of said bottle supporting means including:

a horizontal platform disposed substantially coplanar with the height of the top surface of said outer shell; and a plurality of upwardly disposed projections extending form said platform of said bottle supporting means and below a top surface of the 2-liter PET bottles to be retained, said projections defining a slot and said slot is aligned to cooperate with a side wall of an upper identical case when said upper identical case is disposed at 90° to the lower low depth case and said lower low depth case is empty.

70. The case as in claim 69, wherein:

said case has a center lien of the length of the case extending through the center of the longer pair of said side walls of the case;

said slot of said projection is disposed along the center line of the length of said case; and said slot includes a bottom which is no higher than the top surface of the outer shell.

71. A cross-stacking low depth case for retaining and transporting as many as eight 2-liter PET bottles at a time comprising:

four outer side walls forming a rectangular outer sheel wherein top edges of said side walls define a top surface of the outer shell, the length of said outer shell is twice as long as the width of said outer shell and a center line of the length of the case extends through the center of the longer pair of side walls of the case;

a case bottom diposed substantially within said outer shell and including:

an upper surface which is substantially flat across the 2-liter PET bottle retaining pockets; and a lower surface having means for resting the case bottom on closures of 2-liter PET bottles in a subjacent case and for aligning each closure with said case bottom for stacking said case; and a plurality of means for supporting outer surfaces of 2-liter PET bottles, generally disposed within said outer shell and each supporting having at least one bottle supporting surface, said bottle supporting surfaces defining, in combination with said outer shell and said case bottom upper surface, eight 2-liter PET bottle retaining pockets, with at least one bottle supporting means associated with each pocket;

wherein a first of said plurality of bottle supporting means is disposed about the center line of the length of the case and includes:

a horizontal platform substantially coplanar with the height of the top surface of said outer shell; and a projection extending above and from said horizontal platform, said prohection includes a slot which extends along the center line of the length of the case said slot for receiving a side wall of an identical upper case when said lower low depth case is empty; and wherein the height of said case from said lower surface of said case bottom to a top of said projections is no higher than one-half the height of the stored 2-liter PET bottles to be retained.

72. The case in claim 71, wherein said slot includes a bottom which is no higher than the top surface of the outer shell.

* * * * *

UNITED STATES PATENT AND TRADEMARK OFFICE

CERTIFICATE OF CORRECTION

PATENT NO. : 4,978,002

DATED : December 18, 1990

INVENTOR(S) : William P. Apps, James B. Rehrig and John A. Hagan

It is certified that error appears in the above-identified patent and that said Letters Patent is hereby corrected as shown below:

The title page, showing the illustrative figure, should be deleted and substitute therefor the attached title page.

The twelve (12) Drawing Sheets should be deleted and replaced with the twelve (12) Drawing Sheets as shown on the attached sheets.

Signed and Sealed this

Fifth Day of January, 1993

*Attest:*

DOUGLAS B. COMER

*Attesting Officer*

*Acting Commissioner of Patents and Trademarks*

United States Patent [19]

Apps et al.

[11] Patent Number: 4,978,002

[45] Date of Patent: Dec. 18, 1990

[54] CROSS-STACKING BOTTLE CASE

[75] Inventors: William P. Apps, Anaheim; James B. Rehrig, Rancho Palos Verde, both of Calif.; John A. Hagan, Aldan, Pa.

[73] Assignee: Rehrig-Pacific Company, Inc., Los Angeles, Calif.

[21] Appl. No.: 440,255

[22] Filed: Nov. 22, 1989

Related U.S. Application Data

[62] Division of Ser. No. 186,140, Apr. 26, 1988, Pat. No. 4,899,874.

[51] Int. Cl.[5] ..... B65D 27/00

[52] U.S. Cl. ..... 206/201; 206/203; 206/109; 206/171

[58] Field of Search ..... 206/201, 203, 427, 509, 206/511; 200/20, 22, 21

[56] References Cited

U.S. PATENT DOCUMENTS

| | | | |
|---|---|---|---|
| D. 147,981 | 11/1947 | Lehman | D58/13 |
| D. 195,702 | 7/1963 | Russo | D58/26 |
| D. 201,257 | 6/1965 | Vidal | D58/5 |
| D. 289,938 | 5/1987 | Warwick | 205/203 |
| 1,112,943 | 10/1914 | Stone . | |
| 2,064,518 | 12/1936 | Brogden | 220/97 |
| 2,411,673 | 11/1946 | Vechey, Jr. | 220/21 |
| 2,530,481 | 11/1950 | Rawn, Jr. | 220/76 |
| 2,535,493 | 12/1950 | Gerber | 220/97 |
| 2,588,805 | 2/1951 | Cross | 220/21 |
| 2,626,079 | 1/1953 | Keller | 220/21 |
| 2,743,030 | 4/1956 | Read, Jr. | 220/21 |
| 2,760,676 | 8/1956 | Knierem | 220/97 |
| 2,840,256 | 6/1958 | Cobb, Jr. | 220/4 |
| 2,928,530 | 3/1960 | Sauey | 206/3 |
| 2,935,222 | 5/1960 | O'Connell | 220/21 |

(List continued on next page.)

FOREIGN PATENT DOCUMENTS

| | | |
|---|---|---|
| 247904 | 8/1962 | Australia . |
| 680197 | 10/1966 | Belgium . |
| 693216 | of 1967 | Belgium . |
| 965056 | 3/1975 | Canada . |
| 1109433 | 9/1981 | Canada . |
| 99827 | 2/1984 | European Pat. Off. . |
| 1207268 | 6/1966 | Fed. Rep. of Germany . |
| 1486412 | 5/1969 | Fed. Rep. of Germany . |
| 1285689 | 4/1961 | France . |
| 1351218 | 3/1963 | France . |
| 1518610 | 2/1968 | France . |
| 2401087 | of 1979 | France . |
| 6505562 | 10/1966 | Netherlands . |
| WO82/01536 | 5/1982 | PCT Int'l Appl. . |
| 2135278 | 8/1924 | United Kingdom . |
| 943947 | 12/1963 | United Kingdom . |
| 1032916 | 6/1966 | United Kingdom . |
| 1115343 | 5/1968 | United Kingdom . |
| 1120067 | 7/1968 | United Kingdom . |
| 1152038 | 5/1969 | United Kingdom . |
| 1312701 | 4/1970 | United Kingdom . |
| 1319726 | 6/1973 | United Kingdom . |
| 1330778 | 9/1973 | United Kingdom . |
| 2079256 | 1/1982 | United Kingdom . |
| 2158044A | 11/1985 | United Kingdom . |

*Primary Examiner*—Joseph Man-Fu Moy

*Attorney, Agent, or Firm*—Banner, Birch, McKie & Beckett

[57] ABSTRACT

The stackable low depth bottle case of the present invention includes four side walls and a bottom portion. A plurality of upwardly projecting hollow columns extend upwardly within the side walls. The columns, walls, and bottom portion define a plurality of bottle retaining pockets. The bottle retaining pockets have flat surfaces to permit retention of bottles without base indentations and to permit rotation of petaloid bottles. The columns extend upwardly from the base portion a distance approximately one third of the height of the bottles to be retained. The columns may be hollow to permit empty cases to stack top to bottom. The lower surface of the bottom portion has circular concave portions with central retaining openings to facilitate stacking of loaded cases top to bottom. When a case is disposed on a lower filled case, the bottle tops of the lower case are guided toward the central retaining openings by the circular concave portions.

72 Claims, 12 Drawing Sheets

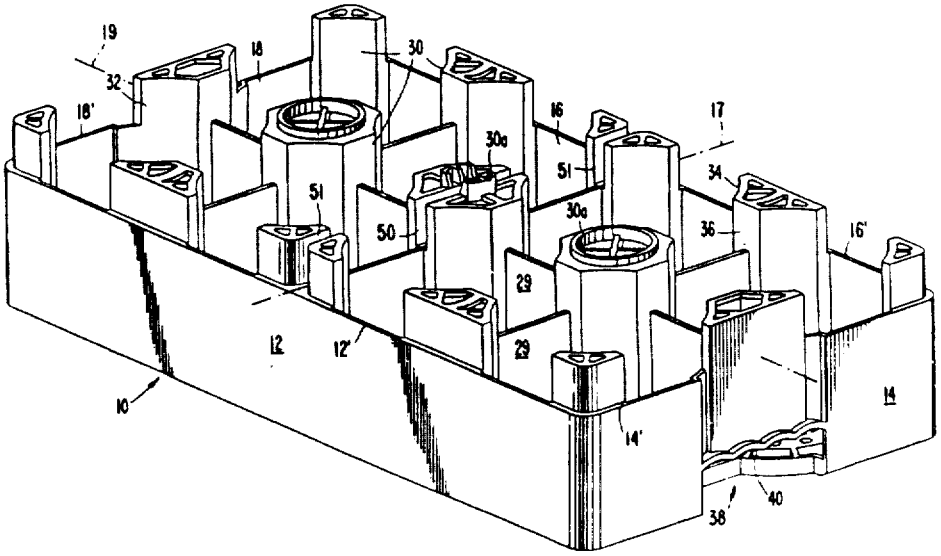

UNITED STATES PATENT AND TRADEMARK OFFICE

CERTIFICATE OF CORRECTION

PATENT NO. : 4,978,002

DATED : December 18, 1990

INVENTOR(S) : William Patrick Apps, James B. Rehrig and John A. Hagan

It is certified that error appears in the above-identified patent and that said Letters Patent is hereby corrected as shown below:

Col. 1, line 21, change "cabonated" to —carbonated—;
line 22, change "suprisingly" to —surprisingly—;
line 35, change "load" to —loads—; and
line 42, change "warehouse" to —warehouses—.

Col. 2, line 10, change "oftem" to —often—;
line 12, change "side" to —sides—;
line 22, change "disadvanatges" to —disadvantages—;
line 28, change "in" (first occurrence) to —is—;
line 32, change "two" to —too—; and
line 60, change "Bunnel" to —Bunnell—.

Col. 3, line 21, change "U.S. Pat. No. '530" to —'530 patent—;
line 22, change "PEt" to —PET—;
line 34, change "pentaloid" to —petaloid—;
line 38, change "cross-stacking" to —cross stacking—;
line 51, change "identations" to —indentations—; and
line 66, change "identations" to —indentations—.

Col. 4, line 2, change "of" to —to—;
line 9, change "casee" to —case—;
line 18, change "effectuve" to —effective—;
line 22, change "characterized" to —characterize—;
line 26, change "illustrated" to —illustrate—; and
line 27, change "described" to —describe—.

UNITED STATES PATENT AND TRADEMARK OFFICE

CERTIFICATE OF CORRECTION

PATENT NO. : 4,978,002

DATED : December 18, 1990

INVENTOR(S) : William Patrick Apps, James B. Rehrig and John A. Hagan

It is certified that error appears in the above-identified patent and that said Letters Patent is hereby corrected as shown below:

Col. 5, line 7, change "lines" to —line—;
line 22, change "sheel" to --shell—;
line 38, delete "not"; and
line 41, change "Verical" to --Vertical—.

Col. 6, line 1, change "column" to --columns—;
line 5, change "FIG." to --FIGS.—;
line 12, change "centerline" to —center line—;
line 27, change "amd" to --and--;
line 38, after "often" insert —bottle—; and
line 40, after "bottle" insert --tops—.

Col. 7, line 5, after "ribs" insert —21—;
line 34, after "surfaces" (first occurrence) insert --34--;
line 42, change "column" to —columns—;
line 45, change "advantges" to --advantages--; and
line 46, change "has" to --have--.

UNITED STATES PATENT AND TRADEMARK OFFICE

CERTIFICATE OF CORRECTION

PATENT NO. : 4,978,002

DATED : December 18, 1990

INVENTOR(S) : William Patrick Apps, James B. Rehrig and John A. Hagan

It is certified that error appears in the above-identified patent and that said Letters Patent is hereby corrected as shown below:

Col. 7, line 63 (claim 1, line 10), change "wtih" to —with—.

Col. 8, line 12 (claim 4, line 3), change "interblocks" to —interlocks—.
line 30 (claim 6, line 30), change "extends" to —extend—.
line 51 (claim 11, line 4), change "diposed" to —disposed—.
line 68 (claim 12, line 2), change "shape" to —shell—.

Col. 9, line 14 (claim 15, line 2), change "extend" to —extends—.
line 28 (claim 18, line 4), change "bottle" to —bottles—.

Col. 10, line 2 (claim 26, line 2), change "retaning" to —retaining—;
line 6 (claim 27, line 2), change "poitn" to —point—.
line 21 (claim 31, line 6), change "directions" to —direction—;
line 26 (claim 31, line 11), change "with" to —within—;
line 33 (claim 31, line 18), change "saud" to —said—; and
line 34 (claim 31, line 19), change "poskets" to —pockets—.
line 45 (claim 32, line 3), change "shorted" to —shorten—; and
line 49 (claim 32, line 7), change "pluraliyt" to —plurality—.

Col. 11, line 40 (claim 46, line 1), change "whereins" to —wherein—.
Col. 12, line 8 (claim 50, line 10), change "with" to —within—; and
line 9 (claim 50, line 11), change "substantiall" to —substantially—.

line 16 (claim 51, line 7), change "on" to —in—; and
line 19 (claim 51, line 10), change "with" to —within—.
line 38 (claim 54, line 9), change "deifining" to —defining—; and
change "diposed" to —disposed—.

UNITED STATES PATENT AND TRADEMARK OFFICE

CERTIFICATE OF CORRECTION

PATENT NO. : 4,978,002

DATED : December 18, 1990

INVENTOR(S) : William Patrick Apps, James B. Rehrig and John A. Hagan

It is certified that error appears in the above-identified patent and that said Letters Patent is hereby corrected as shown below:

Col. 12, line 56 (claim 57, line 1), change "cae" to —case— and after "wherein" insert --:--;
line 64 (claim 57, line 9), change "in" to —on--; and
line 57 (claim 57, line 57), change "as" to --has--.

Col. 13, line 6 (claim 60, line 3), change "subsequent" to —subjacent--.
line 20 (claim 61, line 12), after "plurality" insert --of bottle—.
line 28 (claim 62, line 1), change "an" to —as--.
line 36 (claim 63, line 4), change "disposes" to —disposed--.
line 39 (claim 64, line 2), after "receiving" insert —means--.
line 61 (claim 65, line 17), after "projections" insert —positioned--.

Col. 14, line 14 (claim 68, line 7), change "acros" to —across—.
line 15 (claim 69, line 1), change "transposrting" to --transporting--;
line 38 (claim 69, line 38), change "wtih" to —with— ;
line 53 (claim 69, line 53), change "form" to --from--;
line 62 (claim 70, line 62), change "lien" to —line--.

line 5 (claim 71, line 5), change "sheel" to —shell—;
line 11 (claim 71, line 11), change "diposed" to --disposed--;
line 21 (claim 71, line 21), after "supporting" insert —means—; and
line 35 (claim 71, line 35), change "prohection" to --projection—.

line 1 (claim 71, line 1), after "case" insert —as—.